US010323828B2

(12) United States Patent
Castillo et al.

(10) Patent No.: US 10,323,828 B2
(45) Date of Patent: Jun. 18, 2019

(54) LIGHTING APPARATUS WITH REFLECTOR AND OUTER LENS

(71) Applicant: Cree, Inc., Durham, NC (US)

(72) Inventors: Mario A. Castillo, New Braunfels, TX (US); Kurt S. Wilcox, Libertyville, IL (US); William L. Dungan, Cary, NC (US); Russell S. Schultz, Union Grove, WI (US); Brian Kinnune, Racine, WI (US)

(73) Assignee: Cree, Inc., Durham, NC (US)

( * ) Notice: Subject to any disclaimer, the term of this patent is extended or adjusted under 35 U.S.C. 154(b) by 502 days.

(21) Appl. No.: 14/749,497

(22) Filed: Jun. 24, 2015

(65) Prior Publication Data

US 2015/0292714 A1 Oct. 15, 2015

Related U.S. Application Data

(62) Division of application No. 13/841,651, filed on Mar. 15, 2013, now Pat. No. 9,091,417.

(51) Int. Cl.

| | |
|---|---|
| ***F21V 13/04*** | (2006.01) |
| ***F21V 15/01*** | (2006.01) |
| ***F21V 29/85*** | (2015.01) |
| ***F21S 8/06*** | (2006.01) |
| ***F21V 5/02*** | (2006.01) |

(Continued)

(52) U.S. Cl.

CPC ..... *F21V 13/04* (2013.01); *F21S 8/063* (2013.01); *F21V 5/02* (2013.01); *F21V 7/0008* (2013.01); *F21V 7/0041* (2013.01); *F21V 15/01* (2013.01); *F21V 23/003* (2013.01); *F21V 23/0464* (2013.01); *F21V 23/0471* (2013.01); *F21V 29/773* (2015.01); *F21V 29/85* (2015.01); *F21Y 2105/10* (2016.08); *F21Y 2115/10* (2016.08)

(58) Field of Classification Search

CPC combination set(s) only.

See application file for complete search history.

(56) References Cited

U.S. PATENT DOCUMENTS

| | | | |
|---|---|---|---|
| 6,758,582 | B1 | 7/2004 | Hsiao et al. |
| 7,425,084 | B2 | 9/2008 | Ruud et al. |

(Continued)

OTHER PUBLICATIONS

Kim Lighting, Parking Structure PGL7 LED, "The Next Generation of Parking Structure Lighting", Version 2.3 (Aug. 2012), available at: http://www.kimlighting.com/content/products/literature/literature_files/kl_pgl7led_lit.pdf, (24 pages), printed on Apr. 26, 2013.

*Primary Examiner* — Nimeshkumar D Patel
*Assistant Examiner* — Jacob R Stern
(74) *Attorney, Agent, or Firm* — Myers Bigel, P.A.

(57) ABSTRACT

A lighting apparatus is provided with a first housing assembly formed from a thermally conductive material and a second housing assembly formed of a thermally conductive material. At least one electrical component is positioned within the first housing assembly and the at least one electrical component is in thermally conductive contact with the first housing assembly. At least one light source is in thermally conductive contact with the second housing assembly. The second housing assembly is not in thermally conductive contact with the first housing assembly, such that thermal energy from the first housing assembly does not directly transfer to the second housing assembly.

11 Claims, 15 Drawing Sheets

(51) Int. Cl.

| | |
|---|---|
| ***F21V 7/00*** | (2006.01) |
| ***F21V 23/04*** | (2006.01) |
| ***F21V 29/77*** | (2015.01) |
| ***F21V 23/00*** | (2015.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2005/0068777 | A1* | 3/2005 | Popovic ..... | B60Q 1/2611<br>362/307 |
| 2006/0044814 | A1* | 3/2006 | Ikeda ..... | F21S 8/083<br>362/382 |
| 2013/0092960 | A1 | 4/2013 | Wilcox et al. | |

* cited by examiner

LIGHTING APPARATUS WITH REFLECTOR AND OUTER LENS

CROSS-REFERENCE TO RELATED APPLICATIONS

This divisional application claims the benefit of U.S. patent application Ser. No. 13/841,651, filed Mar. 15, 2013, the contents of which is incorporated herein by reference in this application in its entirety.

REFERENCE REGARDING FEDERALLY SPONSORED RESEARCH OR DEVELOPMENT

Not Applicable

BACKGROUND OF THE INVENTION

1. Field of Invention

The present invention generally relates to a lighting apparatus. More particularly, the present invention relates to a lighting apparatus that uses light emitting diodes (LEDs) to perform indirect lighting.

2. Description of the Background of the Invention

Traditionally, many lamps have used incandescent or high intensity discharge (HID) light sources. When mounted to a structure, such as a ceiling or a wall, such lamps may emit light directly through a lens below the light source. Recently, however, LEDs have been found to be very efficient light sources as compared to incandescent and HID light sources. As such, converting lighting systems from using HID and incandescent lights to LED lights in order to make use of LED efficiencies is desirable.

The use of point sources such as LEDs in some instances, however, can cause undesirable glare. A phenomenon known as cave effect may also occur if all or nearly all light is directed downwards while little to no light is directed upwards. The use of LEDs may also pose challenges with heat dissipation as LEDs can generate nontrivial amounts of thermal energy.

Various sensors can be used to conserve energy by allowing a lighting apparatus to only turn on when needed. Some light fixtures have sensors positioned outside the light fixture or near the exterior of the light fixture. However, by being exposed outside the housing of the lighting fixture, the sensors may become damaged, especially in areas of vehicle activity such as in a parking structure.

Accordingly, there is a need for an LED lighting apparatus that reduces undesirable glare and provides efficient thermal management within the lighting apparatus. Additionally, there is a need for a lighting apparatus that reduces the potential for sensor damage without inhibiting the operation of the sensor used with the lighting apparatus.

SUMMARY

In one aspect, a lighting apparatus is provided with a first housing assembly formed from a thermally conductive material and a second housing assembly formed of a thermally conductive material. At least one electrical component is positioned within the first housing assembly and the at least one electrical component is in thermally conductive contact with the first housing assembly. At least one light source is in thermally conductive contact with the second housing assembly. The second housing assembly is not in thermally conductive contact with the first housing assembly, such that thermal energy from the first housing assembly does not directly transfer to the second housing assembly.

In another aspect, a lighting apparatus is provided having a housing assembly with a lower assembly and at least one other assembly. At least one light source is contained within the housing assembly and at least one sensor is recessed within the lower housing assembly. The light source is configured to react to changes in light detected by the sensor.

In a further aspect, a lighting apparatus is provided having an upper housing assembly, a lower housing assembly, and a reflector positioned between the upper housing assembly and the lower housing assembly. At least one electrical component is at least partially housed by the upper housing assembly, and at least one outer electrical component is at least partially housed by the lower housing assembly. The reflector has a hollow portion such that electrical wiring is adapted to extend from the lower housing assembly through the hollow portion of the reflector to the upper housing assembly.

In another aspect, a lighting apparatus is provided having an upper housing assembly, a lower housing assembly, and a reflector positioned between the upper housing assembly and the lower housing assembly. At least one electrical component is at least partially housed by the upper housing assembly, and at least one other electrical component is at least partially housed by the lower housing assembly. The reflector has a hollow portion such that electrical wiring is adapted to extend from the lower housing assembly through the hollow portion of the reflector to the upper housing assembly.

In yet another aspect, a lighting apparatus is provided having an upper housing assembly, a middle housing assembly positioned below and attached to the upper housing assembly, and a lower housing assembly positioned below and attached to the middle housing assembly such that the upper housing assembly is vertically spaced apart from the lower housing assembly. At least one electrical component is housed within the upper housing assembly and at least one light source is housed within the lower housing assembly. Thermal energy emitted by the at least one electrical component is conducted along a first thermal path away from the at least one electrical component, thermal energy emitted by the at least one light source is conducted along a second thermal path away from the at least one light source. The middle housing assembly is substantially non-conductive of thermal energy relative to the upper housing assembly, and the second thermal path is decoupled from the first thermal path.

In a further aspect, a lighting apparatus is provided having a housing, including an outer lens, at least one light source positioned within the housing, and a reflector positioned within the housing. At least a portion of the reflector is asymmetrical about a plane defined by a longitudinal axis of the reflector and a vector perpendicular to the longitudinal axis of the reflector. The at least one light source is configured to emit light towards the reflector, and the reflector is configured to reflect light emitted by the light source out through the outer lens.

DETAILED DESCRIPTION OF THE PREFERRED EMBODIMENTS

Figure 1A:
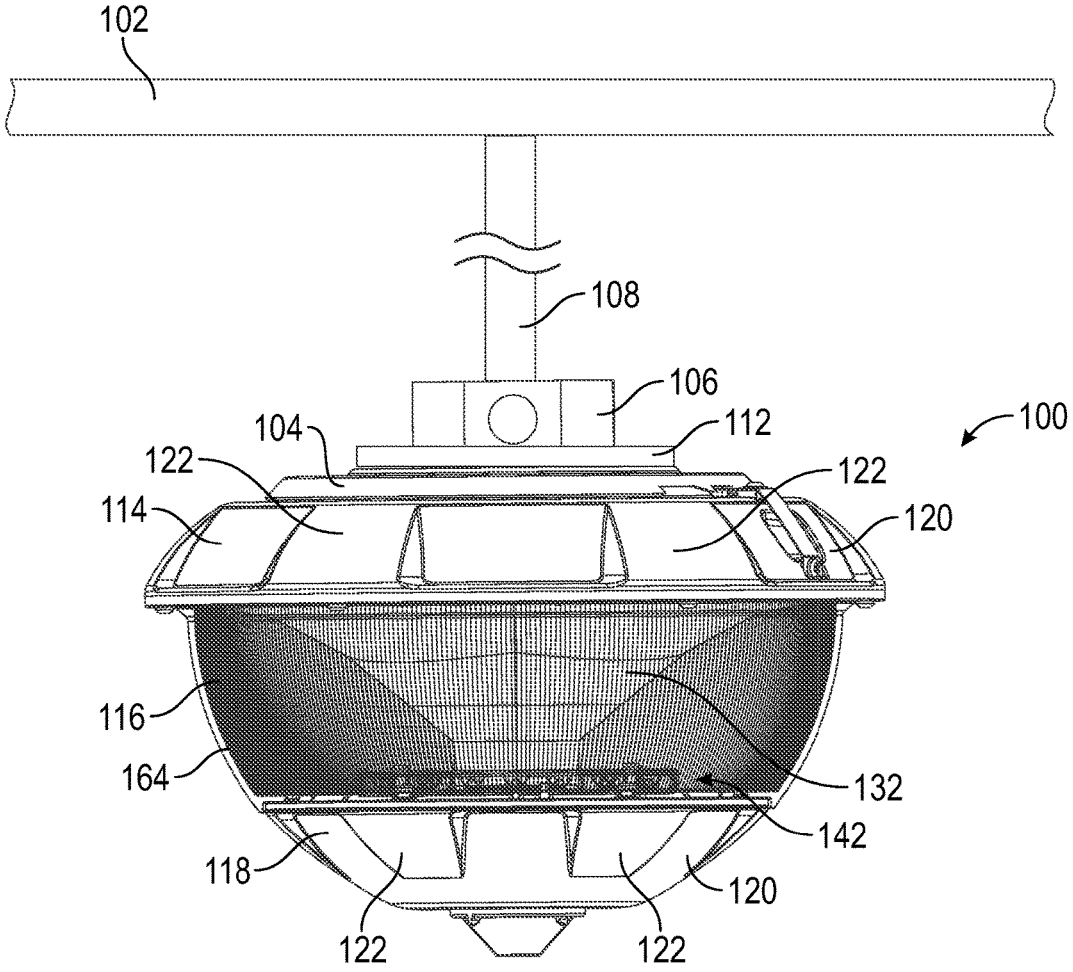
FIG. 1A is a front plan view of a lighting apparatus attached to a ceiling with a support post according to an embodiment of the present invention.
Figure 1B:
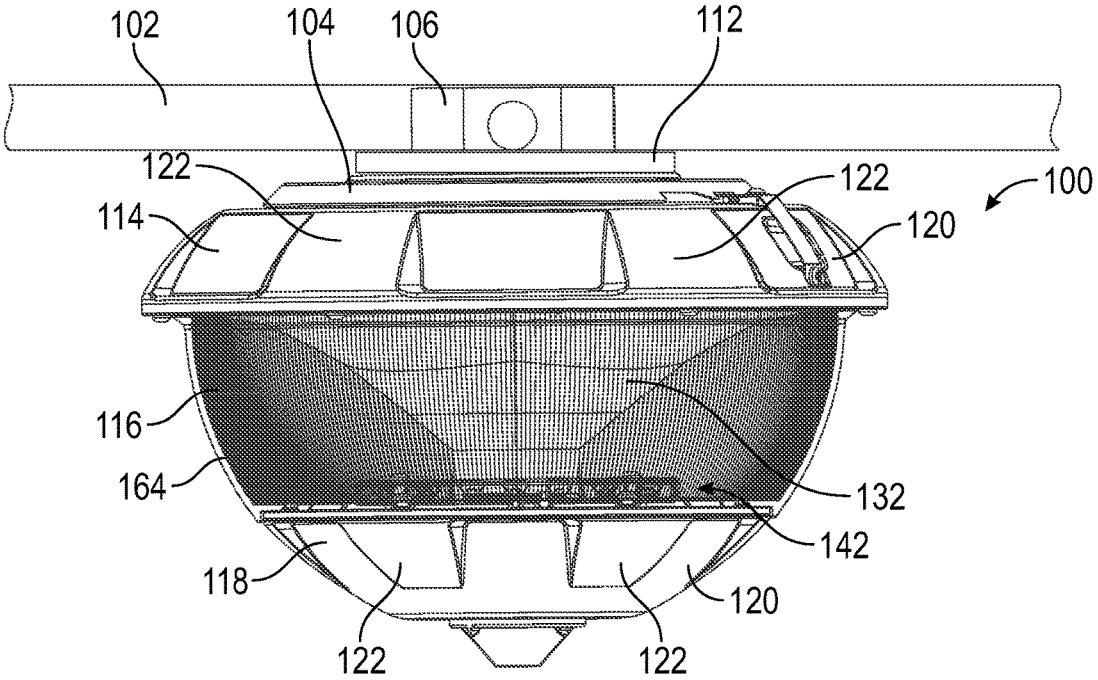
FIG. 1B is a front plan view of the lighting apparatus of FIG. 1A attached to a ceiling without a support post according to an embodiment of the present invention.

As seen in FIGS. 1A and B, a lighting apparatus 100 is configured to be mounted below a ceiling 102, or other support structure such as a wall or mounting platform. In this example, the lighting apparatus 100 is securable to an annular mounting plate 104. The mounting plate 104 may be attached to a junction box 106 by screws, for example. The junction box 106 may be attached to the ceiling 102 by support post 108 or other suitable mounting structures known to those of ordinary skill in the art. Referring to FIG. 1A, electrical wiring to provide power to the lighting apparatus 100 may be run from the ceiling 102 or wall through the support post 108 to the junction box 106. The example shown in FIG. 1A may be a pendent mount arrangement with junction box 106 connected to a support structure 102 at a short distance by support post 108. Alternatively, electrical wiring may be run directly from the ceiling 102 or wall to the junction box 106, as seen, for example, in FIG. 1B. As seen in the alternative example in FIG. 1B, direct mounting arrangements of the lighting apparatus 100 may be used in which the junction box 106 is positioned within and flush with the ceiling or abuts the Electrical wiring coupled with electrical components of the lighting apparatus 100 may also extend from the lighting apparatus 100 to the junction box 106 to allow for electrical connections within the junction box 106 required for operation of the lighting apparatus 100. A gasket 112 may also be used to provide a seal at the juncture of the mounting plate 104 and the junction box 106 such that the gasket 112 is positioned on an upper surface of the mounting plate 104 and surrounding a lower portion of the junction box 106.

Referring again to FIGS. 1A and 1B, the lighting apparatus 100, in this example, includes an upper housing assembly 114, a middle housing assembly 116, and a lower housing assembly 118. The lower housing assembly 118 may be secured to the middle housing assembly 116 by screws, and the middle housing assembly 116 may be secured to the upper housing assembly 114 by screws, for example. Alternative approaches to connect the housing assemblies 114, 116, 118 may selectively be employed. The upper housing assembly 114 and lower housing assembly 118 may be formed from die cast aluminum or other suitable thermally conductive material. The outer surface 120 of the upper housing assembly 114 and lower housing assembly 118 may include raised fins 122. The raised fins 122 may be spaced radially around the upper housing assembly 114 and lower housing assembly 118 for improved heat dissipation from the lighting apparatus 100. The raised fins 122 may also provide an aesthetic appeal. In alternative embodiments, the middle housing assembly 116 and lower housing assembly 118 may be joined together into one assembly or further divided into more assemblies.

Figure 2A:
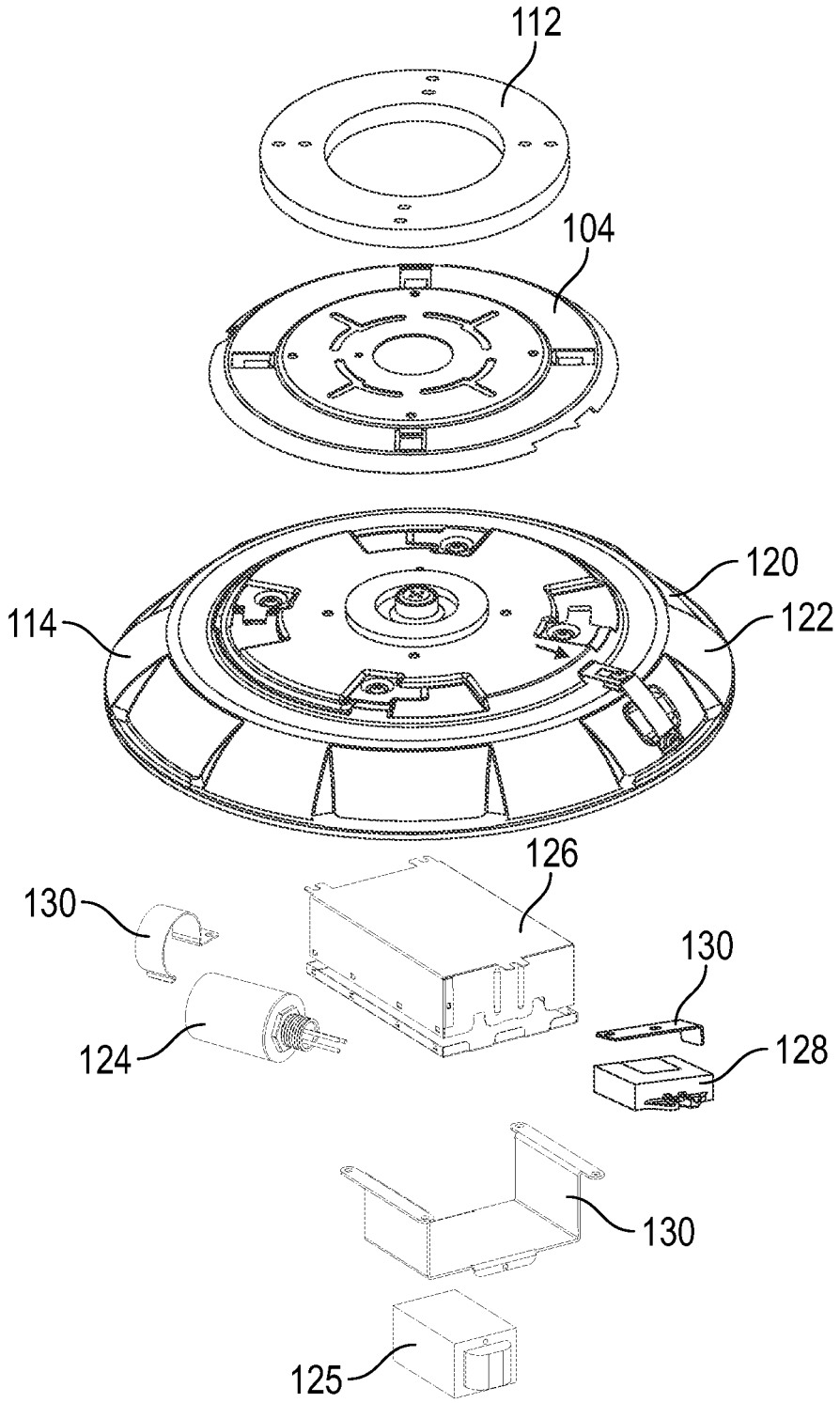
FIG. 2A is an exploded view of an upper housing assembly of the lighting apparatus.

As seen in FIG. 2A, the upper housing assembly 114 may house several electrical components. The electrical components housed by the upper housing assembly 114 may include, for example, a surge protector 124, a transformer 125, an LED driver 126, and a current limiter 128. The LED driver 126, for example, may be an Advance Xitanium Driver with a 50 watt (W) input, and 0-10 volt (V) dimming capability. The driver 126 may be designed for 120, 230, and/or 277 V (50/60 Hz). The current limiter 128 may be configured to limit current and facilitate dimming. The transformer 125, for example, may be a 347V or 480V (50/60 Hz) transformer. One or more components of an LED driver circuit may selectively be at least partially housed by the upper housing assembly 114. Brackets 130 may be used to hold the electrical components in place within the upper housing assembly 114. Electrical wiring 110 may be coupled to the surge protector 124, transformer 125, LED driver 126, and current limiter 128 in order to provide power. In alternative embodiments, the current limiter 128, or transformer 125, or both, may selectively be omitted.

Figure 2B:
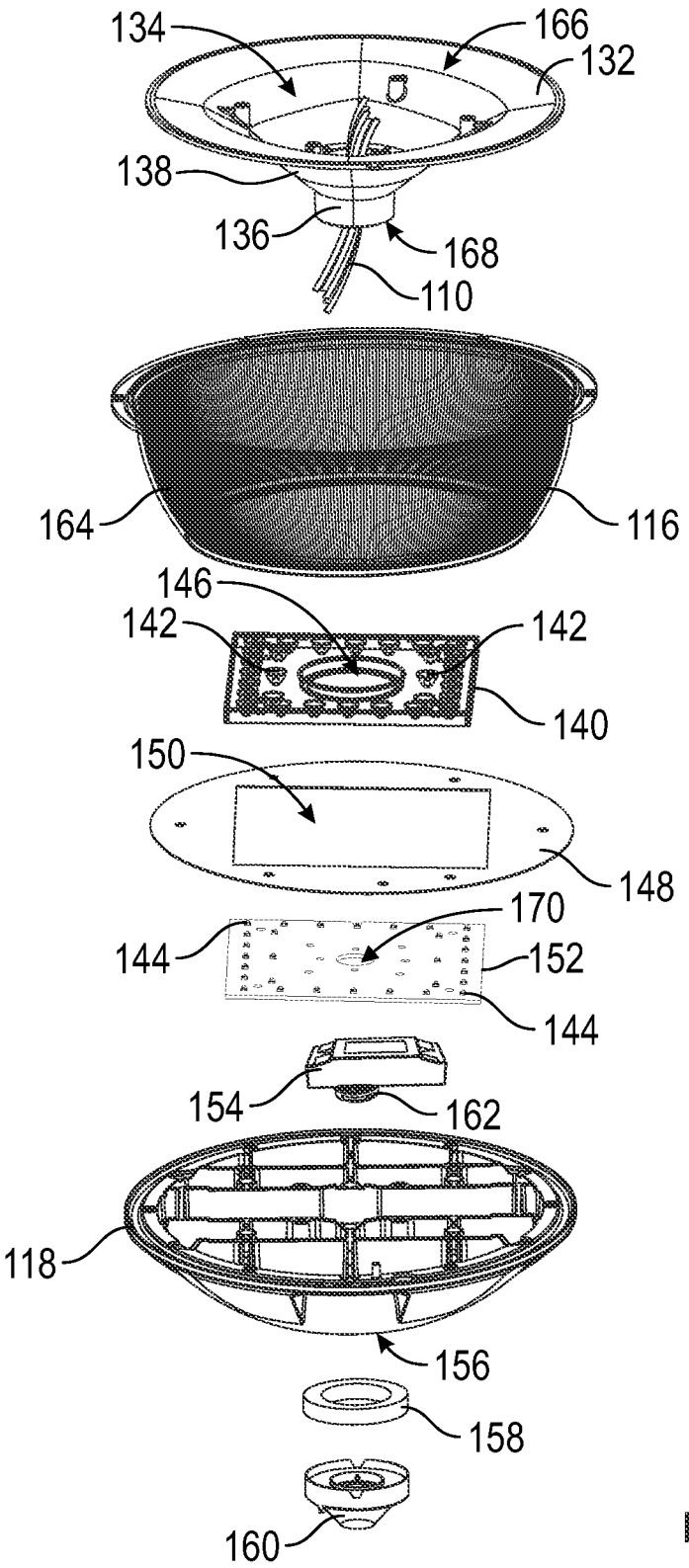
FIG. 2B is an exploded view of a middle housing assembly and a lower housing assembly of the lighting apparatus.

As seen in FIG. 2B, the middle housing assembly 116 and lower housing assembly 118 house several additional components of the lighting apparatus 100. A reflector 132 is housed within the middle housing assembly 116. The reflector 132 extends between the lower housing assembly 118 and the upper housing assembly 114. The reflector 132 is a secondary optic, meaning that the reflector 132 may be the second optical component a light ray encounters before exiting the lighting apparatus 100. The reflector 132 may be formed of a reflective material, such as a reflective plastic, glass, or metal material. The reflector 132 includes an axial pathway therethrough 134 for electrical wiring 110 and electrical connections to be run from the upper housing assembly 114 to the lower housing assembly 118. The axial pathway, in this example, may be a hollow portion 134 of the reflector 132 positioned proximate a longitudinal center axis of the lighting apparatus 100.

The reflector 132, in this example, may be formed of a white plastic highly reflective material. Alternatively (or additionally), the reflector 132 may be formed of a mix of specular and highly reflective white material. The white material may enhance the scattering of light rays to soften potential glare effect. The reflector 132 may have a spine-like appearance as it is disposed between the upper housing assembly 114 and the lower housing assembly 118 (See FIGS. 1A and 1B). The reflector 132 has a base portion 136 and a body portion 138, as seen, for example, in FIG. 2B. The base 136 of the reflector, in this example, is preferably cylindrical in shape. Alternatively, the base 136 may be triangular, rectangular, or some other shape known to those of ordinary skill. The body 136 of the reflector 132 may have a parabolic or conical shape as shown, for example, in FIGS. 2B and 7A.

Referring again to FIG. 2B, a one piece collimator plate 140 is positioned below the reflector 132. The collimator plate 140 may include a plurality of individual collimator lenses 142 on the plate. In this example, the collimator lenses 142 act as a primary optic, meaning that the lenses 142 are the first optical component a light ray will encounter before exiting the lighting apparatus 100. The collimator lenses 142 are configured to direct light from an LED 144 upwards in a narrow spread. The spread, for example, may be of about 15 degrees, or, alternatively, between 10 and 20 degrees. The collimator lenses 142 may also be adjusted to direct light in different directions and/or to widen or narrow the spread as desired. The collimator plate 140 includes a cylindrical opening 146 at approximately the center of the collimator plate 140. The base 136 of reflector 132 is positioned at approximately the center of the collimator plate 140, in the cylindrical opening 146.

A reflector plate 148 may be positioned below the collimator plate 140. The reflector plate 148 is a tertiary optic, meaning that the reflector plate 148 may be the third optical component a light ray encounters before exiting the lighting apparatus 100. The reflector plate 148 is substantially flat, planar, and circular in shape to sit within and cover portions of the lower housing assembly 118. Alternatively, the reflector plate may be triangular, rectangular, or some other geometric shape. The reflector plate 148 may include a rectangular cavity 150 positioned at an approximate center location of the reflector plate 148. In alternative embodiments, the cavity 150 may be off-center or non-rectangular. The reflector plate 148 is configured to upwardly reflect light that the reflector 132 has reflected downwards into the reflector plate 148.

As seen in FIG. 2B, an LED plate 152 is positioned below the collimator plate 140 within the cavity 150 of the reflector plate 148. The reflector plate 148 and LED plate 152 may be attached to the lower housing assembly 118 by screws or other means of attachment known to those of ordinary skill in the art. The LED plate 152, in this example, includes at least one and preferably a plurality of individual LEDs 144. In one example embodiment of the lighting apparatus 100, the LED plate 152 may include between thirty and forty LEDs 144. In other embodiments, the LED plate 152 may include more or less LEDs 144, as desired. The collimator plate 140 may be positioned and attached above the LED plate 152 such that each LED 144 in the LED plate 152 is coupled to a corresponding collimator lens 142 in the collimator plate 140. The collimator plate 140 may be screwed or otherwise attached to the LED plate 152, the reflector plate 148, and/or the lower housing assembly 118. The LED plate 152 and collimator plate 140 together comprise a lighting module. In alternative embodiments, the collimator plate 140 may be omitted and each LED 144 in the LED plate 152 may be separately and individually coupled to a separate individual collimator lens 142. In further alternative embodiments, the collimator lenses 142 may be replaced by a die component 953 that is positioned over individual LEDs 144 (see FIG. 11A).

Referring again to FIG. 2B, a sensor 154 is positioned below the LED plate 152 and reflector plate 148 in the lower housing assembly 118. The sensor 154 may be a motion sensor, or a light sensor, or a combination motion sensor and light sensor. A motion sensor may be used to analyze nearby light patterns in order to detect motion and turn on the lighting apparatus 100 only when there is motion activity in proximity to the lighting apparatus 100. A light sensor may be used to detect the ambience of light in the surrounding area, allowing a lighting apparatus to remain off during daylight. The sensor 154, for example, may be a passive infra-red (PIR) sensor. The sensor 154 is in electrical communication with the LED driver 126, and the LED driver 126 is in electrical communication with the LED plate 152 for operative control of the LEDs 144. The sensor 154 may be completely housed within the lower housing assembly 118 in order to provide protection to the sensor 154. The sensor 154, in this example, is positioned near an aperture 156 in the lower housing assembly 118 (see FIGS. 6A, 6B) in order to allow the sensor 154 to analyze nearby light patterns.

Figure 6A:
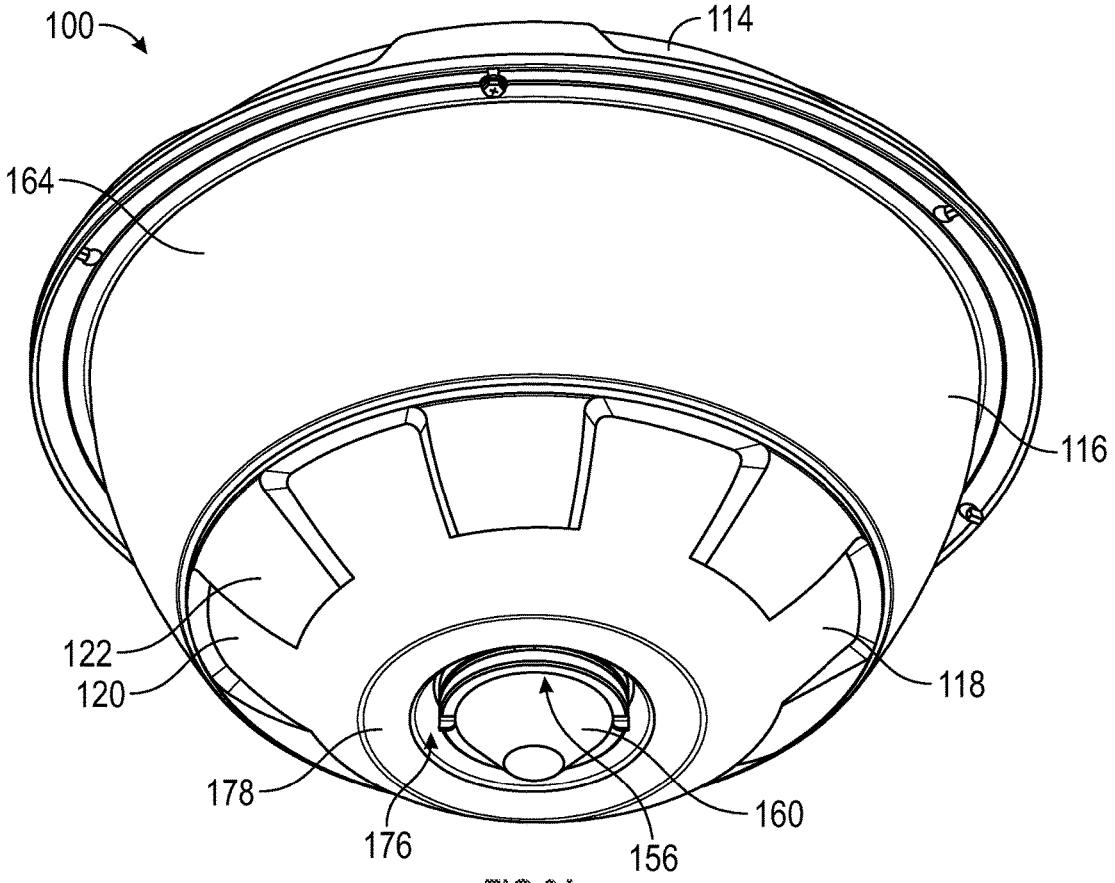
FIG. 6A is a bottom perspective view of the lighting apparatus.
Figure 6B:
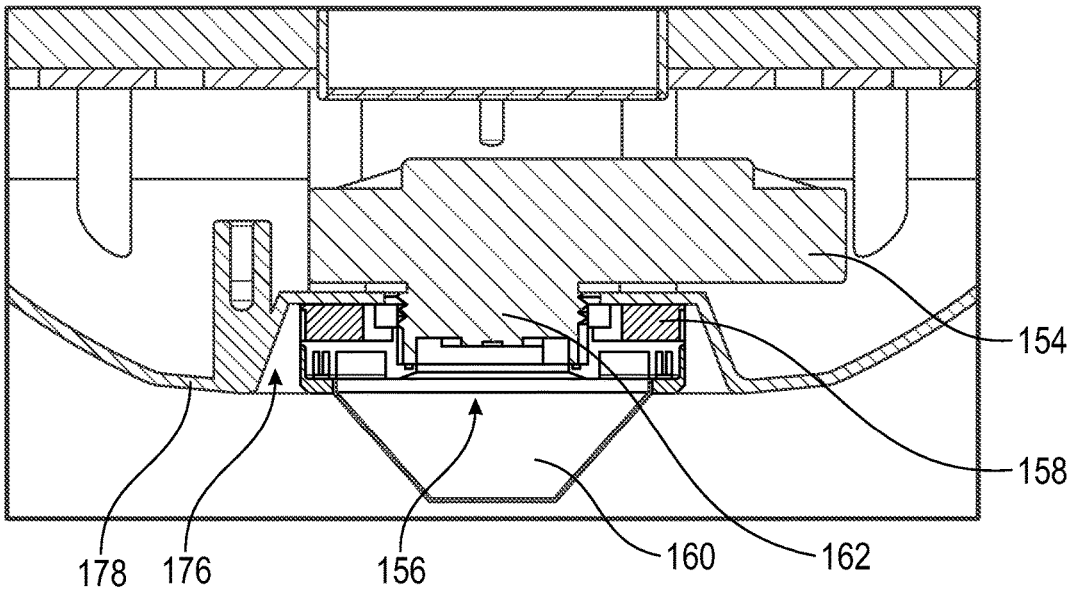
FIG. 6B is a partial cross section of the lighting apparatus showing the placement of the sensor within the lower housing assembly.

A gasket 158 seals sensor 154 in the aperture 156 in the lower housing assembly 118, as may be seen, for example, in FIG. 6B. A wedge shaped bezel 160 is fitted to cover the aperture 156. The aperture 156 is configured to hold and fit an extending cylindrically shaped snout portion 162 of the sensor 154. The bezel 160 is positioned under the snout portion 162 of the sensor 154 in the lower housing assembly 118 in order to provide additional protection against harmful contact, dust, and pollutants. The bezel 160, in this example, is formed of a light transmissive material. In other embodiments, the bezel 160 may be shaped in some other alternative design as known to those of ordinary skill in the art.

As seen in FIGS. 1A, 1B, 2A, and 2B, the reflector 132 is positioned between the upper housing assembly 114 and the lower housing assembly 118 and is disposed within an outer lens 164 of the middle housing assembly 116. The reflector 132 has a hollow interior portion 134 that allows electrical wiring 110 to extend from the lower housing assembly 118 through the hollow portion 134 of the reflector 132 to the upper housing assembly 114. The electrical wiring 110 may include alternating current (AC), direct current (DC), power wiring, and/or communications wiring for the electrical components at the upper housing assembly 114 and the lower housing assembly 118. A top opening 166 of the reflector 132 is positioned adjacent to the upper housing assembly 114. The hollow interior portion 134 of the reflector 132 extends between the top opening 166 and bottom opening 168 of the reflector 132, as seen in FIG. 2B. The reflector 132 is centrally positioned within the outer lens 164 of the lighting apparatus 100. As such, the bottom opening 168 of the reflector 132 is positioned proximate a longitudinal center axis of the lighting apparatus 100, allowing the electrical wiring 110 to be run through a central region of the lighting apparatus 100 between the lower and upper housing assemblies 118, 114 with the electrical wiring 110 internally contained within the hollow portion 134 interior of the reflector 132.

As seen in FIGS. 2A and 2B, the upper housing assembly 114 houses various electrical components including the LED driver 126. The LED module (which, in this example, includes the LED plate 152 and the collimator plate 140) is mounted to and supported by the lower housing assembly 118. In this example arrangement, the LED driver 126 of the upper housing assembly 114 may be electrically coupled to the LEDs 144 of the LED module via electrical wiring 110 that extends through the hollow portion 134 of the reflector 132. As seen in FIG. 2B, the LED plate 152 has a central opening 170 and the collimator plate 140 has a central opening 146 allowing electrical wiring to be run and extend therethrough. The lower housing assembly 118 also houses the sensor 154 that is configured to analyze light patterns. In this example arrangement, the sensor 154 may be electrically coupled to the LED driver 126 (or other components) of the upper housing assembly 114 via electrical wiring 110 extending through (and internally contained within) the hollow portion 134 of the reflector 132. Other electrical components of the upper housing assembly 114 and lower housing assembly 118 may be similarly provided with electrical power or communication carried via the electrical wiring 110 extending through the housing assembly.

Figure 3:
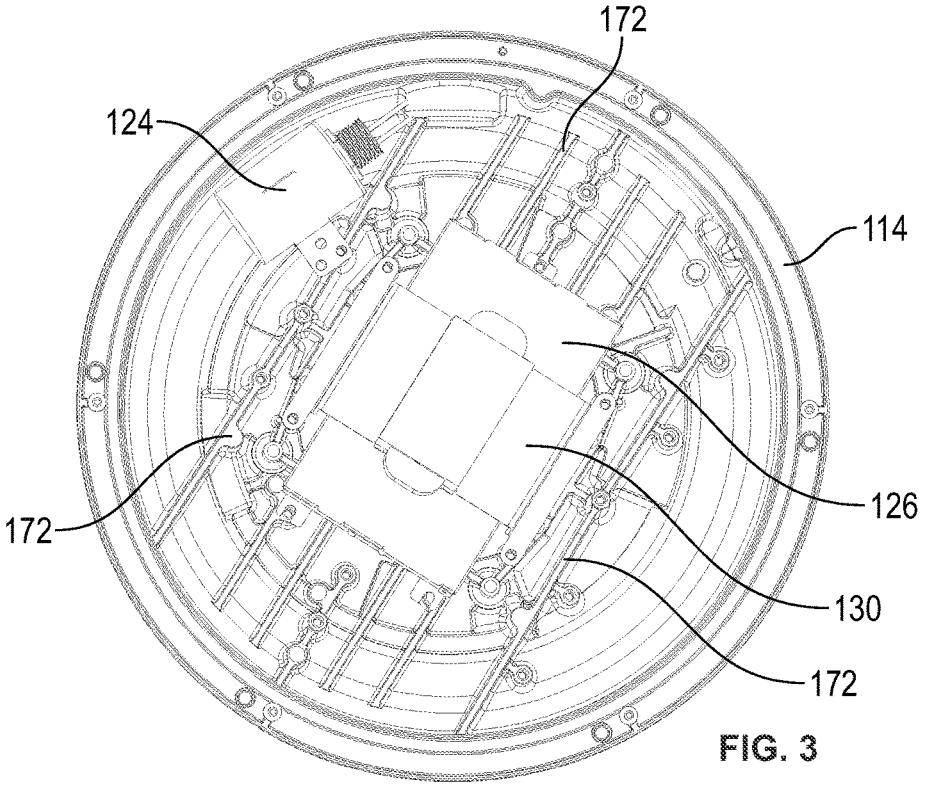
FIG. 3 is a bottom plan view of the upper housing assembly of the lighting apparatus.

As seen in FIG. 3, the upper housing assembly 114 includes thermally conductive elongate ribs 172 formed therein. The elongate ribs 172 are configured to be in thermally conductive communication with the other portions, including the outer surface 120, of the upper housing assembly 114. The ribs 172 may be fitted with screw holes configured to allow brackets holding the surge protector 124, transformer 125, LED driver 126, and current limiter 128 to be attached to thereto. The ribs 172 may be made with the same or different material as the rest of the upper housing assembly 114. The ribs 172 are configured to conduct thermal energy given off by the by the surge protector 124, transformer 125, LED driver 126, and current limiter 128 to other portions of the upper housing assembly 114 where the thermal energy may be dissipated into the air as radiation. In particular, the ribs 172 conduct thermal energy from the centrally housed electrical components in the upper housing assembly 114 to an outer surface 120 of the upper housing assembly 114 to allow for improved heat dissipation.

Figure 4:
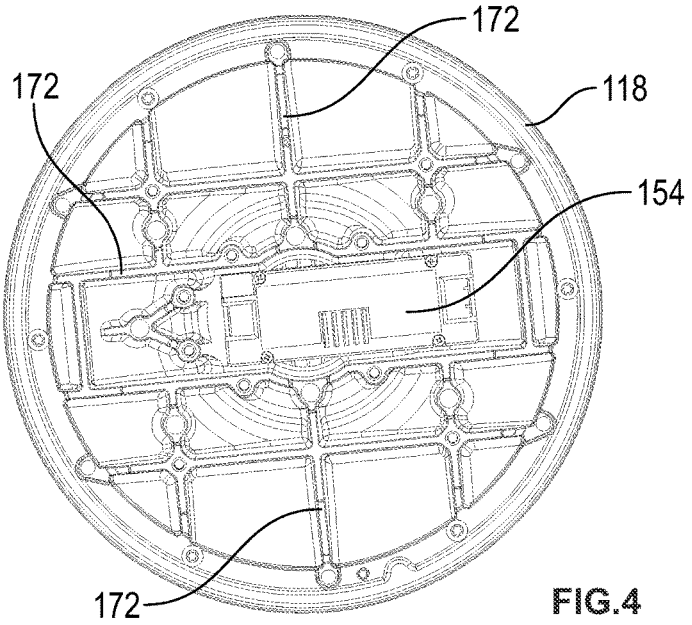
FIG. 4 is a top plan view of the lower housing assembly of the lighting apparatus.

Referring to FIG. 4, the lower housing assembly 118 also includes thermally conductive elongate ribs 172 formed therein. The ribs 172 are configured to be in thermally conductive communication with other portions, including the exterior portion, of the lower housing assembly 118. The ribs 172 may be fitted with screw holes configured to allow the reflector plate 148, LED plate 152, and collimator plate 140 to be attached thereto. The ribs 172 may be made with the same or different material as the rest of the lower housing assembly 118. The ribs 172 are configured to conduct thermal energy given off the by LEDs 144 to other portions of the lower housing assembly 118 where the thermal energy may be dissipated into the air as radiation. Similar to the upper housing assembly 114, the ribs 172 of the lower housing assembly 118 transfer thermal energy towards the outer surface 120 of the lower housing assembly 118 allowing heat to be dissipated into the air. Because the upper housing assembly 114 and lower housing assembly 118 are separated by a middle housing assembly 116 that is not thermally conductive, the upper and lower housing assemblies 114, 118 comprise two separate thermal management systems.

As seen in FIGS. 2A, 2B, 3, and 4, the configuration of the upper, middle, and lower housing assemblies 114, 116, 118, in this example arrangement, provide for efficient thermal management and heat dissipation for the lighting apparatus 100. In this arrangement, both the upper housing assembly 114 and the lower housing assembly 118 are formed from a thermally conductive material, such as die cast aluminum or any other suitable thermally conductive material. When in operation many components of the lighting apparatus 100 generate heat. Electrical components, such as the LED driver 126, surge protector 124, transformer 125, and current limiter 128 are positioned at least partially within the upper housing assembly 114 and are in thermal conductive contact with the outer surface 120 of the upper housing assembly 114. In this example embodiment, the LED driver 126 is spread apart and positioned in a separate housing assembly from the LED module. As such, the LED light sources 144 of the LED plate 152 and the reflector plate 148 are in thermally conductive contact with the lower housing assembly 118. The upper housing assembly 114 and the lower housing assembly 118, in this example, are separated by the middle housing assembly 116 that is formed of a material that is not thermally conductive. In particular, an acrylic outer lens 164 is positioned below the upper housing assembly 114 and above the upper housing assembly 114, in this example embodiment. The outer lens 164 is connected to the upper housing assembly 114 and the lower housing assembly 118. Since the acrylic outer lens 164 of the middle housing assembly 116 is non-metallic, the lower housing assembly 118 and the upper housing assembly 114 are not in thermally conductive contact with each other, such that thermal energy from the upper housing assembly 114 does not directly transfer to the lower housing assembly 118 and vice-versa.

Dissipation of heat generated by the electrical components of the light apparatus 100 is also enhanced through the use of the elongate ribs 172 of the upper housing assembly 114 and elongate ribs 172 of the lower housing assembly 118. (See FIGS. 3 and 14). As described above, the elongate ribs 172 in the interior of the upper housing assembly 114 (FIG. 3) transfer and/or conduct thermal energy generated from the LED driver 126 and other components of the upper housing assembly 114 along a thermal path to the outer surface 120 of the upper housing assembly 114. Similarly, the elongate ribs 172 positioned in the interior of the lower housing assembly 118 transfer and/or conduct thermal energy generated by the LEDs 144 and other components of the lower housing assembly 118 along a thermal path to the outer surface 120 of the lower housing assembly 118.

Because the thermal paths taken to conduct thermal energy in the upper and lower housing assemblies 114, 118 are separate and decoupled, thermal energy from the upper housing assembly 114 does not directly transfer to the lower housing assembly 118 and vice-versa. Raised fins 122 (FIGS. 1A, 1B, 2A, 2B) formed in the exterior surface of and spaced radially around the upper and lower housing assemblies 114, 118 also assist in improved heat dissipation at the lighting apparatus 100.

Figure 14:
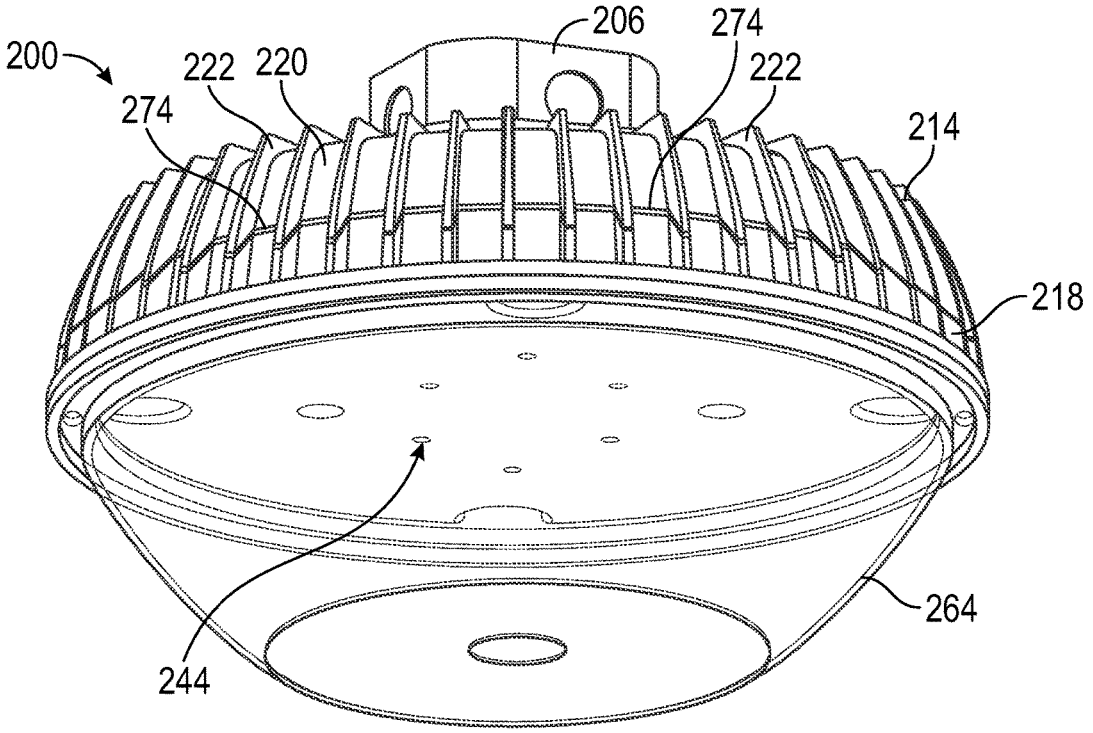
FIG. 14 is a lower perspective view of an alternative embodiment of a lighting apparatus having alternative upper and lower housing assemblies.

In alternative embodiments, other non-metallic materials having minimal thermal conductivity properties, such as foam material, may be used to separate metal-based upper and lower housing assemblies 214, 218 of a lighting apparatus 200, such as seen in the example of FIG. 14. In the alternative lighting apparatus 200 example shown in FIG. 14, the upper housing assembly 214 is separated from the lower housing assembly 218 by a foam in place material 274 that is neither metallic nor thermally conductive. In this alternative embodiment, the upper housing assembly 214 and the lower housing assembly 218 may be formed of a thermally conductive material, such as a metal material. The outer surface 220 of the upper housing assembly 214 and lower housing assembly 218 may include raised fins 222. The raised fins 222 may be spaced radially around the upper housing assembly 214 and lower housing assembly 218 for improved heat dissipation from the lighting apparatus 200. The raised fins 222 may also provide an aesthetic appeal. The foam in place material 274 prevents the thermally conductive upper housing assembly 214 and lower housing assembly 218 from coming into thermally conductive contact with one another. Other material that is not thermally conductive may be used as an alternative to foam.

In the lighting apparatus 200, seen in the example embodiment of FIG. 14, the outer lens 264 is positioned below the lower housing assembly 218 and there is no reflector. The lighting apparatus 200 in this alternative embodiment has LEDs 244 in the lower housing assembly 218 above the outer lens 264, and emits light directly downwards and outwards through the outer lens 264. The split cast arrangement seen in the embodiment in FIG. 14 thus employs a direct optical lighting configuration. The electrical components of the lighting apparatus 200 are still retained within the upper housing assembly 214, and both the upper housing assembly 214 and lower housing assembly 218 have thermally conductive internal ribs 272 configured to transfer thermal energy towards an outer surface of the upper housing assembly 214 and lower housing assembly 218. Because the upper housing assembly 214 and lower housing assembly are separated by a foam in place material 274 that is not thermally conductive, the upper and lower housing assemblies 214, 218 comprise two separate thermal management systems.

Figure 15:
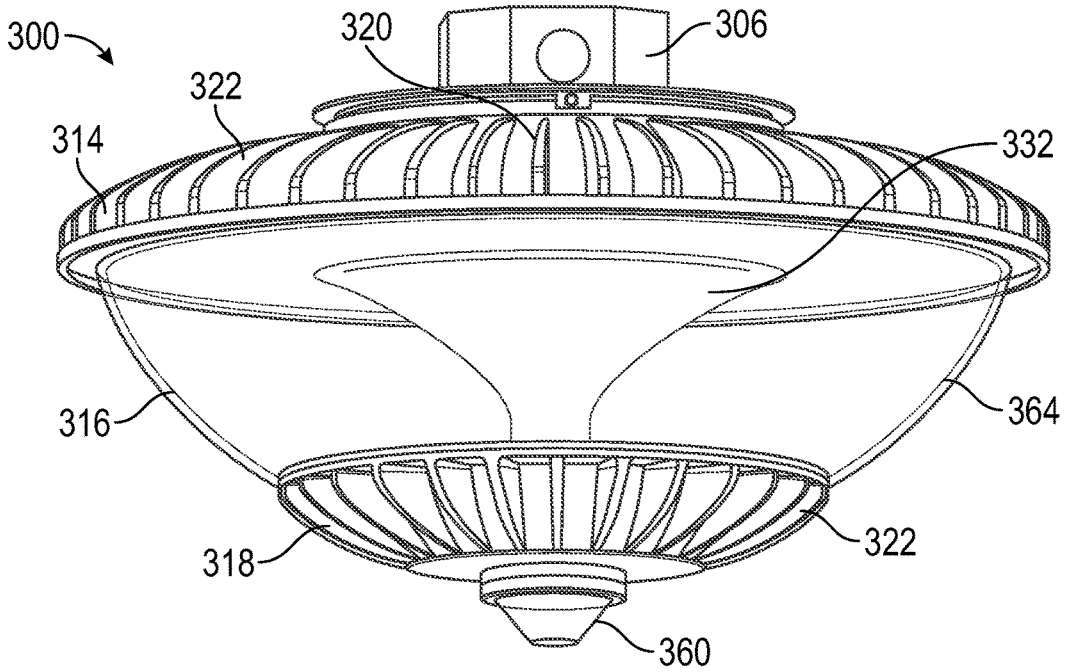
FIG. 15 is a lower perspective view of another alternative embodiment of a lighting apparatus having alternative upper and lower housing assemblies.

As seen in the example alternative embodiment in FIG. 15, a lighting apparatus 300 uses thin pronounced protruding fins 322 on the outer surface 320 of the upper housing assembly 314 and lower housing assembly 318 to increase the area in which heat dissipation may occur. The alternative lighting apparatus 300, seen for example in FIG. 15, is otherwise substantially the same as the lighting apparatus 100, shown, for example, in FIGS. 1-4. In the example lighting apparatus 300 of FIG. 15, the upper housing assembly 314 and lower housing assembly 318 are again separated by a middle housing assembly 316 that is not thermally conductive. Additionally, the upper housing assembly 314 and lower housing assembly 318 in this example seen in FIG. 15 are formed of a thermally conductive material, such as die cast aluminum. The middle housing assembly 316 may include an outer lens 364 configured to focus light emitted from LEDs 344 and reflected by the reflector 332 and reflector plate 348 in an indirect lighting configuration. Because the upper housing assembly 314 and lower housing assembly are separated by middle housing assembly 316 that is not thermally conductive, the upper and lower housing assemblies 314, 318 comprise two separate thermal management systems with added fins 322 to increase the rate of heat dissipation.

Figure 16:
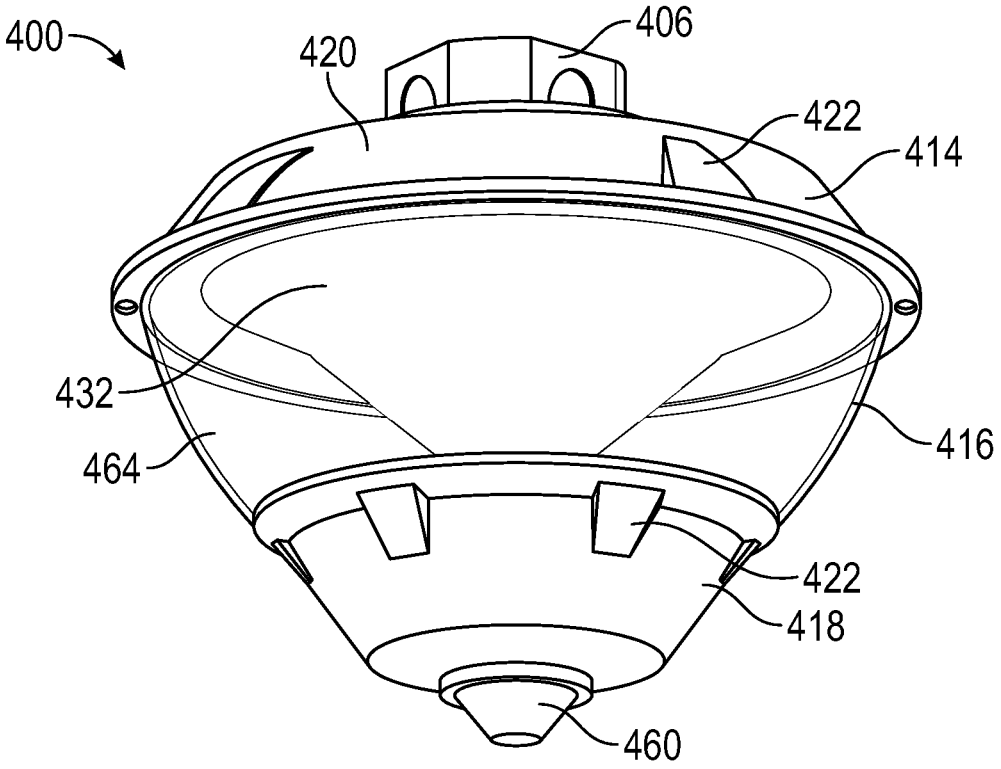
FIG. 16 is a lower perspective view of yet another alternative embodiment of a lighting apparatus having alternative upper and lower housing assemblies.

As seen in the example alternative embodiment in FIG. 16, a lighting apparatus 400 uses small protruding fins 422 on the outer surface 420 of the upper housing assembly 414 and lower housing assembly 418 to increase the area in which heat dissipation may occur. The alternative lighting apparatus 300, seen for example in FIG. 15, is otherwise substantially the same as the lighting apparatus 100, shown, for example, in FIGS. 1-4. In the example lighting apparatus 300 of FIG. 15, the upper housing assembly 414 and lower housing assembly 418 are again separated by a middle housing assembly 416 that is not thermally conductive. Additionally, the upper housing assembly 414 and lower housing assembly 418 in this example seen in FIG. 15 are formed of a thermally conductive material, such as die cast aluminum. The middle housing assembly 416 may include an outer lens 464 configured to focus light emitted from LEDs 444 and reflected by the reflector 432 and reflector plate 448 in an indirect lighting configuration. Because the upper housing assembly 414 and lower housing assembly are separated by middle housing assembly 416 that is not thermally conductive, the upper and lower housing assemblies 414, 418 comprise two separate thermal management systems with added fins 422 to increase the rate of heat dissipation.

Figure 17:
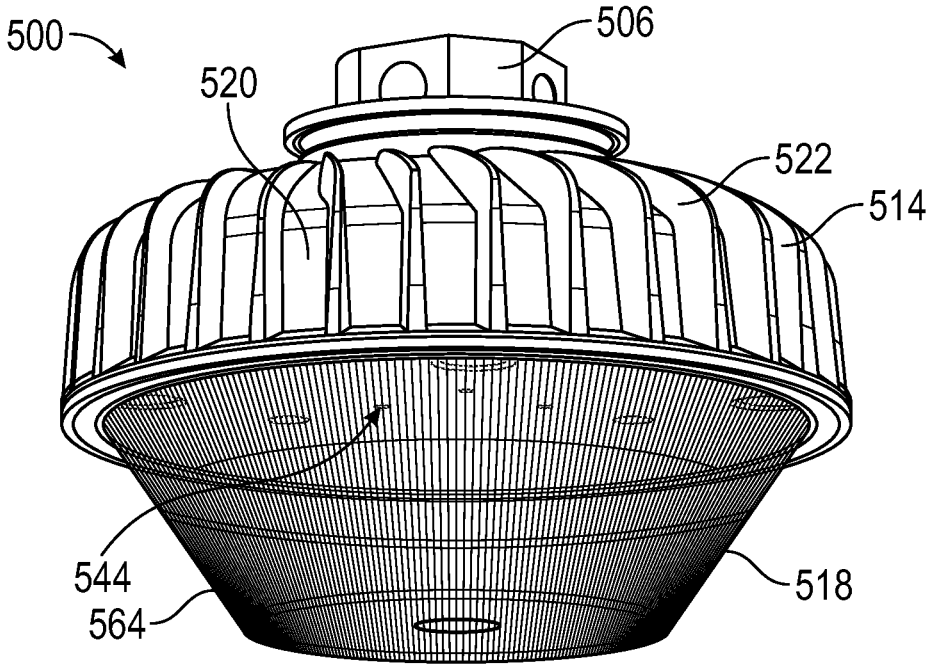
FIG. 17 is a lower perspective view of a further alternative embodiment of a lighting apparatus having alternative upper and lower housing assemblies.

Referring to the example alternative embodiment in FIG. 17, a lighting apparatus 500 also uses thin pronounced protruding fins 522 on the outer surface 520 of the upper housing assembly to increase the area in which heat dissipation may occur. The upper housing assembly 514 may be formed of a thermally conductive material, such as die cast aluminum. The lower housing assembly 518 may be include an outer lens 564 configured to focus light emitted from LEDs 544 in a direct lighting configuration. The lighting apparatus 500 does not have a middle housing 516.

Figure 5:
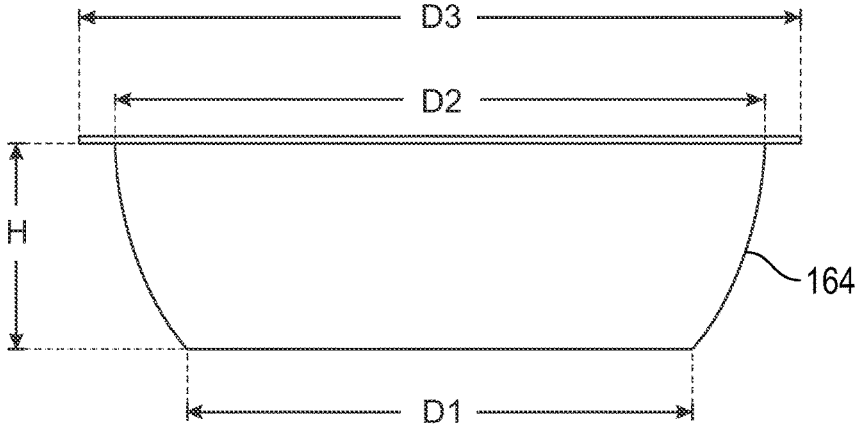
FIG. 5 is a diagram illustrating dimensions of an outer lens of the lighting apparatus.

Referring now to FIG. 5, the middle housing assembly 116 of the lighting apparatus 100, in this example, includes an outer lens 164 configured to focus light emitted from the LEDs 144. The outer lens 164 of the middle housing assembly 116, for example, may be a single piece acrylic optic and carrier lens with an electrical discharge machining (EDM) finish. The outer lens 164 may, for example, be a Makrolon, 5VA rated, molded reflector. The outer lens 164, in this example, is preferably not substantially thermally conductive. The outer lens 164, in this example, is a quaternary optic of the lighting apparatus 100, meaning that the lens 164 may be the fourth optical component a light ray may encounter before exiting the lighting apparatus 100. The interior surface of outer lens 164 is formed with ribs and/or prisms that are configured to combine and blur together light rays so that the appearance of a point source (or point sources) is lessened, and thus the perception of glare is lessened. The ribs and/or prisms of the outer lens 164 may also split and scatter light rays so that some will bounce back inside the lighting apparatus 100 and be reflected off the reflector 132 and reflector plate 148 until it once again hits the outer lens 164.

Figure 12:
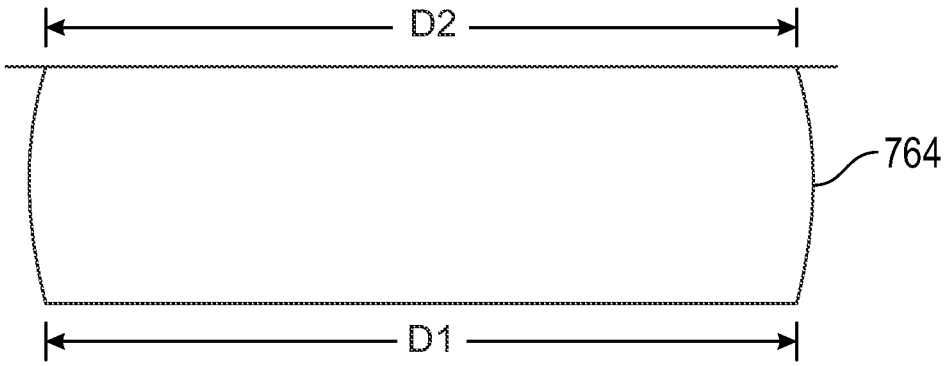
FIG. 12 is a diagram illustrating dimensions of an alternative embodiment of an outer lens.
Figure 13:
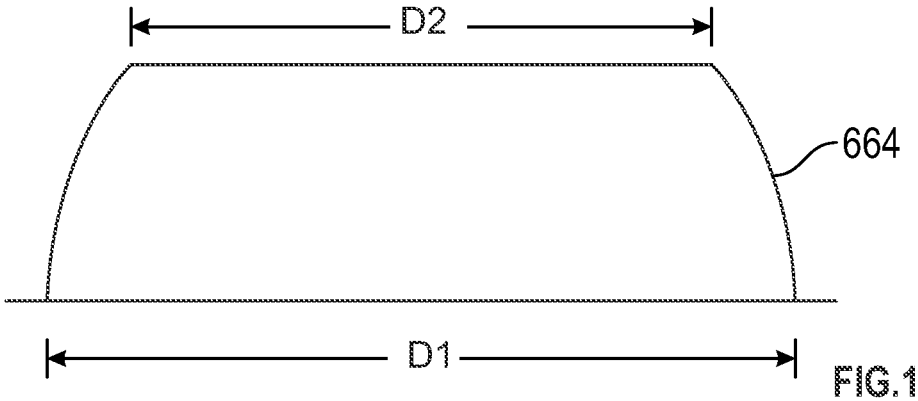
FIG. 13 is a diagram illustrating dimensions of another alternative embodiment of an outer lens.

Referring again to FIG. 5, the outer lens 164 may be configured in the shape of a truncated cone. The lower portion of the outer lens 164 is configured to be attached to the upper portion of the lower housing assembly 118. The upper portion of the outer lens 164 is configured to be attached to the lower portion of the upper housing assembly 114. The lower portion of the outer lens 164 has a diameter D1 that is less than the diameter D2 upper portion of the outer lens 164. In this example, the ratio of D2 to D1 may be approximately 4:3. More particularly, in this example, D1 may be 9.162 inches (233 mm) and D2 may be 11.75 inches (298 mm). In this example, the height of the lens H may be 3.738 inches (95 mm), and the outer diameter D3 of the lens may be 13 inches (330 mm). The ratio of D2 to D1 in alternative examples may selectively range between 1:1 and 5:3. In other embodiments, the dimensions of the upper and lower portions of the outer lens 664 may be reversed, and the diameter of the upper portion of the outer lens 664 D2 may be less than the diameter of the lower portion of the outer lens 664 D1, with the ratio of D2 to D1 being approximately 3:4 (see, e.g., the embodiment in FIG. 13). In the alternative embodiment shown, for example, in FIG. 13, the outer lens 664 appears as a truncated cone, with the sidewalls appearing to curve downwards and outwards as they extend from the upper portion towards the lower portion. The top and bottom of the outer lens 664 appear flat and planar in the alternative embodiment shown, for example, in FIG. 13. The ratio of D2 to D1 in alternative embodiments may selectively range between 3:5 and 1:1. In a further embodiment, the upper and lower diameters of the outer lens 764 may be the same, with the ratio of D2 to D1 being approximately 1:1 (see e.g., the embodiment in FIG. 12). In the alternative embodiment shown, for example, in FIG. 12, the outer lens 764 appears as a truncated sphere, with the sidewalls appearing bowed, curving outwards before coming back inwards. The top and bottom of the outer lens 764 also appear flat and planar in the alternative embodiment shown, for example, in FIG. 12. The alternative embodiments of the outer lens 664, 764 shown, for example, in FIGS. 12 and 13, may be made from the same or a different material as the outer lens 164.

Figure 8A:
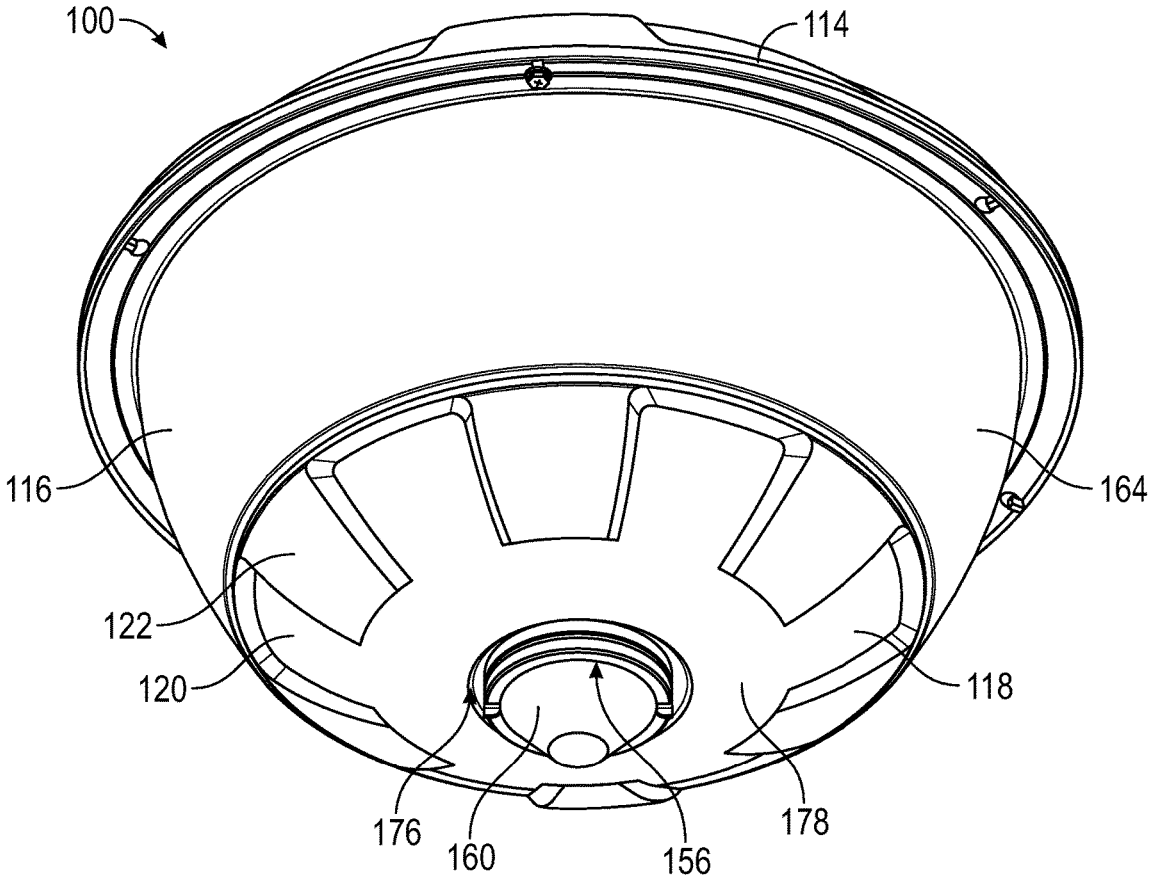
FIG. 8A is a lower perspective view of an alternative lower housing assembly.
Figure 8B:
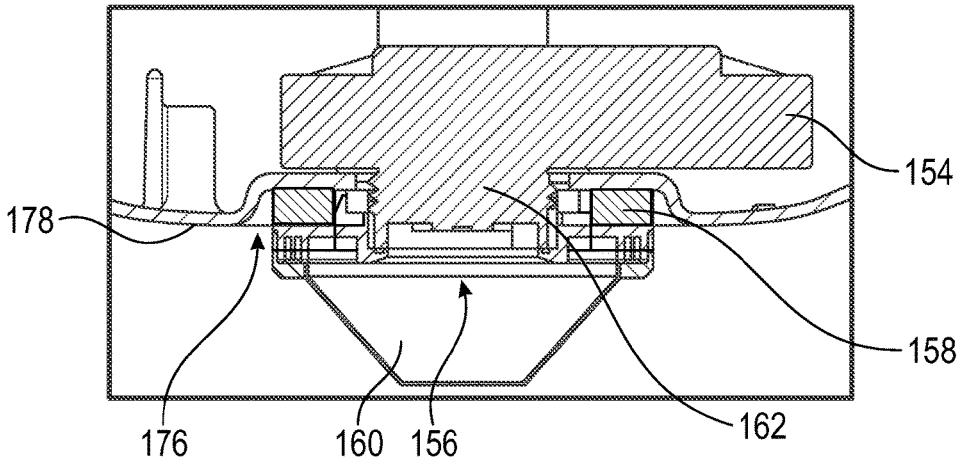
FIG. 8B is a partial cross section of the alternative lower housing assembly of FIG. 8A, showing the placement of the sensor within the alternative lower housing assembly.
Figure 9A:
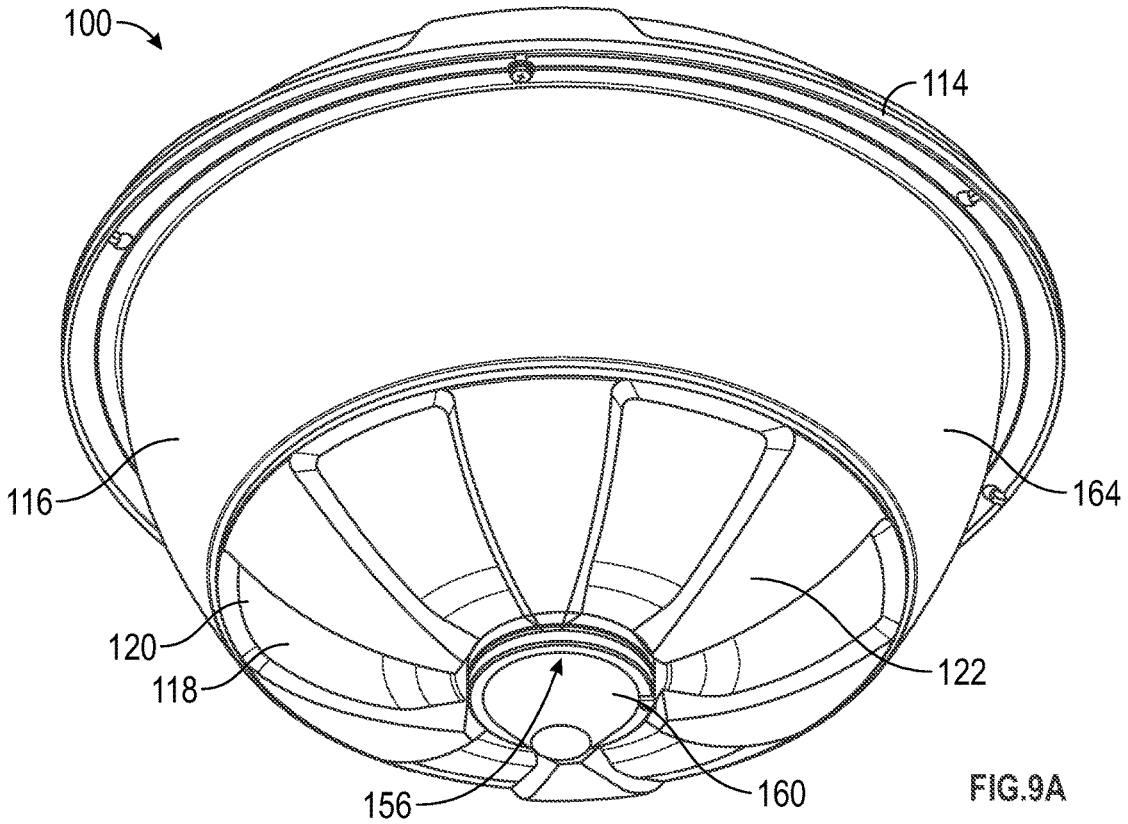
FIG. 9A is a lower perspective view of another alternative lower housing assembly.
Figure 9B:
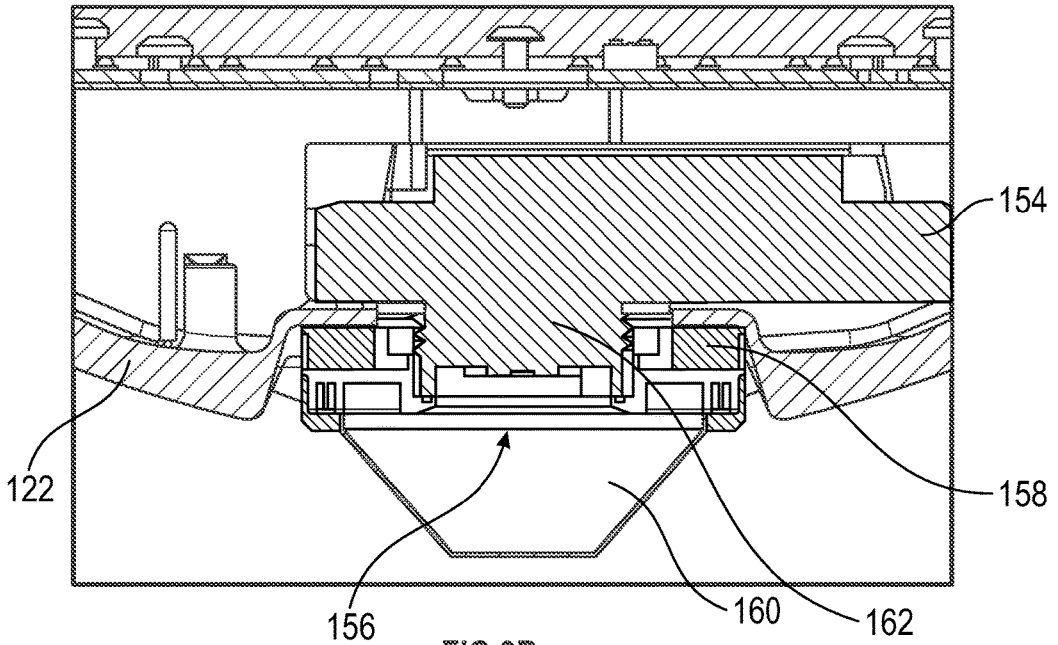
FIG. 9B is a partial cross section of the alternative lower housing assembly of FIG. 9A, showing the placement of the sensor within the alternative lower housing assembly.

As seen in FIGS. 6A and 6B, the lower housing assembly 118 may be formed to protect the sensor 154. In this example, an aperture 156 is located at a bottom region of the lower housing assembly 118. An extending snout portion 162 of the sensor 154 is located within a fully recessed region 176 of the lower housing assembly 118. Since the snout portion 162 of the sensor is positioned adjacent to the aperture 156 the sensor 154 is able to analyze light patterns sensed through the aperture 156. Additionally, as seen in FIGS. 6A and 6B, the outer surface 120 of the lower housing assembly 118 curve down, under, and around the snout 162 of the sensor 154 in the recessed region 176. The outer surface 120 of the lower housing assembly 118 flattens and becomes planar in an annular rim 178 around the recessed region 176. In an alternative embodiment, the outer surface 120 of the lower housing assembly 118 may, for example, extend down and flatten into an annular rim 178 that is even with or above a portion of the snout 162 of the sensor 154 in a partially recessed region (see e.g., FIGS. 8A and 8B). In another alternative embodiment, the rim 178 around the recessed region 176 may not be flat, and the recessed region 176 may be at least partially surrounded by fins 122 on the lower housing assembly 118 that extend down to the rim 178 (see e.g, FIGS. 9A and 9B).

The lighting apparatus 100 protects a sensor 154 positioned proximate a bottom region of the lower housing assembly 118 without inhibiting the ability of the sensor 154 to analyze nearby light patterns. The sensor 154 may be fully recessed within the lower housing assembly 118, as seen in FIG. 6B, to protect the sensor from potentially damaging exposure outside the housing of the lighting apparatus 100 (due to, for example, the elements, nearby activities, moving vehicles, etc.). The sensor 154 is positioned adjacent to the aperture 156 located at the bottom region of the lower housing assembly 118 such that the sensor 154 is able to analyze light patterns through the aperture 156. As shown in FIGS. 2A, and 2B electrical wiring 110 may be run through the central hollow portion 134 of the reflector 132 providing for electrical connections between components of the upper housing assembly 114 and the lower housing assembly 118. As such, the LED driver 126 in the upper housing assembly 114 may be in electrical communication with the sensor 154 as well as the LEDs 144 mounted in the lower housing assembly 118, allowing for operation of the LEDs 144 in response to conditions sensed by the sensor 154. To further protect the sensor 154, the wedge shaped bezel 160 formed of light transmissive material is positioned to cover the aperture 156. Additionally, the lower housing assembly 118 may include raised fins 122 spaced radially around the lower housing assembly 118. (see FIG. 6A). In some embodiments, the raised fins 122 extend towards the aperture 156 positioned at the bottom region of the lower housing assembly 118, providing further protection.

Figure 7A:
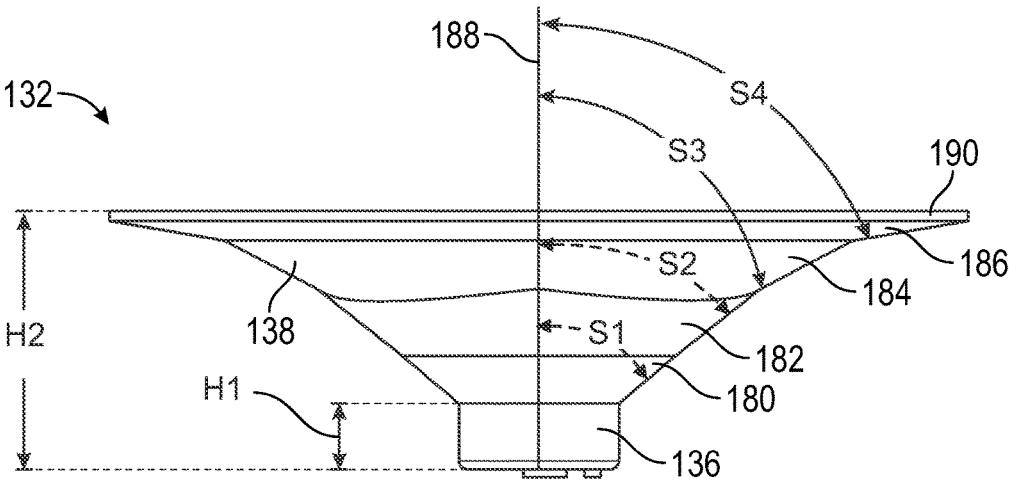
FIG. 7A is a diagram illustrating dimensions of a reflector of the lighting apparatus.

Referring now to FIG. 7A, the body 138 of the reflector 132 may be formed of several portions. In this example, the body 138 of the reflector 132 includes a lower portion 180, a lower intermediate portion 182, an upper intermediate portion 184, and an upper portion 186. The base 136 extends upwards to the lower portion 180. In this example, the height H1 of the base 136 may be approximately 0.882 inches (22.4 mm). The lower portion 180 of the body 138 may appear trapezoidal in shape, with the top end of the lower portion 180 being wider than the bottom end of the lower portion 180. The slope S1 of the lower portion 180 sidewalls may be around 50 degrees, for example, as measured from a central axis 188 of the reflector 132. The lower intermediate portion 182 is positioned above the lower portion 180 and also appears trapezoidal, though the slope S2 of the sidewalls of the lower intermediate portion 182 is shallower than the slope S1 of the sidewalls of the lower portion 180. The slope S2 of the sidewalls of the lower intermediate portion 182 may be about 51.3 degrees, for example, as measured from a central axis 188 of the reflector. The upper intermediate portion 184 is above the lower intermediate portion 182 and may, for example, appear trapezoidal. The upper intermediate portion 184 may have sidewalls with a shallower slope S3 than the lower intermediate portion 182. The upper intermediate portion 184 may have sidewalls with a slope S3 around 62.5 degrees, as measured from a central axis of the reflector 132. The upper portion 186 is above the upper intermediate portion 184, in this example, and may appear trapezoidal with sidewalls having a shallower slope S4 than any of the other portions. The upper portion 186 may have sidewalls with a slope S4 of approximately 79.7 degrees, for example, as measured from a central axis of the reflector 132. The upper portion 186 may extend upwards from the upper intermediate portion 184 and terminate at an upper rim 190. The upper rim 190 may, for example, be positioned above the bottom of the base 136 at a height H2 of about 3.5 inches (88.9 mm), for example.

The reflector 132 is substantially continuous throughout. As seen in FIG. 7A, the reflector 132 appears shaped like a "Y," with sidewalls tapering and narrowing annularly from the upper rim 190 to the base 136. At the base 136 the sidewalls of the reflector spine cease to taper and instead remain parallel in a column, forming the bottom stem of the "Y." The base 136 and the upper portion 186 of the reflector 132 may have a high reflective white surface or finish, while the lower portion 180, lower intermediate portion 182, and upper intermediate portion 184 have a metalized surface or finish.

Figure 7B:
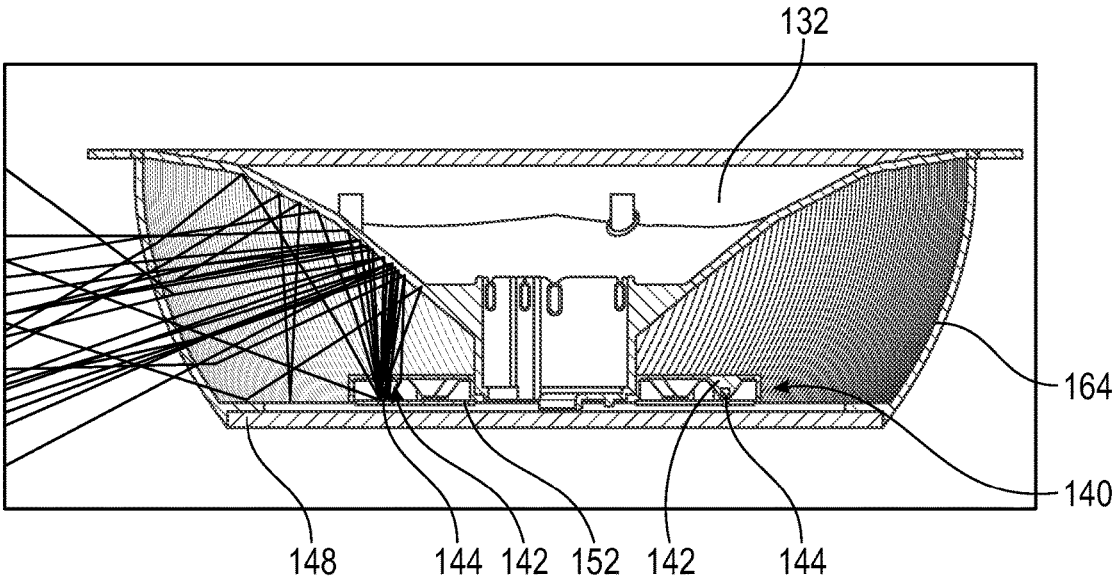
FIG. 7B is a cross section of the middle housing assembly of the lighting apparatus illustrating example paths of light rays from an LED light source.

As seen in FIG. 7B, emitted light from an LED 144 is collimated by a collimating lens 142 into an upwardly directed spread. The upwardly directed spread of light may be reflected by the reflector 132 at different angles depending on where the LED 144 is positioned, what portion of the reflector 132 reflects the light, and at what angle the light approaches the reflector 132, among other factors. In this example, much of the collimated light is reflected out of the lighting apparatus 100 through the outer lens 164 by the reflector 132. Some of the collimated light is reflected into the reflector plate 148 before being reflected out of the lighting apparatus 100 through the outer lens by the reflector plate 148. The various optical components such as the collimator lenses 142, the reflector 132, the reflector plate 148, and the outer lens 164 combine to scatter and blend the emitted light such that the light appears to originate from one diffuse source rather than several point sources, thereby reducing the perception of glare.

Figure 7C:
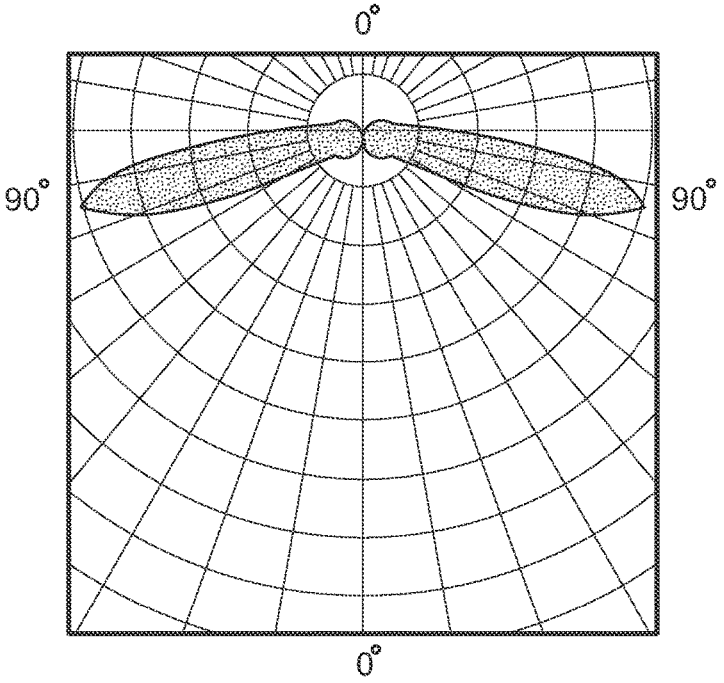
FIG. 7C is a candela plot of the lighting apparatus illustrating example light patterns produced by the reflector of FIG. 1.

Referring now to FIG. 7C, an example candela plot of the lighting apparatus 100 is shown. The radial lines extending from the center circle are disposed at ten degree increments, with the vertical being zero degrees (directly up or directly down) and the horizontal being ninety degrees (directly left or directly right). The annular lines indicate relative amplitude. Emitting given amplitudes of light at angles closer to ninety degrees results in a broader area of illumination than emitting the same amplitudes of light at angles closer to zero degrees, which intensely focuses the light in a more narrow area. In this example, as seen in FIG. 7C, the lighting apparatus 100 configuration with reflector 132 outputs most of its light at angles between 70 and 80 degrees, resulting in a broad area of illumination. Some of the light is also directed upwards reducing the potential for any cave effect. Thus, a lighting apparatus 100 using reflector 132 may be able to illuminate a broad area while also reducing potential for cave effect.

As seen with reference to FIGS. 1A, 1B, 2A, 2B, and 7A-7C, the indirect optical lighting configuration of lighting apparatus 100 provides for the efficient illumination of a broad area while minimizing the perception of glare and reducing or eliminating potential cave effect. The lighting apparatus 100 in particular has a three assembly housing, in this example, in which an outer lens 164 of a middle housing assembly 116 is positioned between upper and lower housing assemblies 114, 118 formed from die cast aluminum. A lighting module positioned within the housing may be secured to the lower housing assembly. The lighting module has an LED plate 152 with LEDs 144 that transmit light through respective collimating lenses 142. The reflector 132 is positioned within the middle housing assembly 116 and is surrounded laterally by the outer lens 164 of the lighting apparatus 100. Reflector plate 148 is positioned within the housing approximately at the level or below the lighting module. The reflector plate reflects light emitted by the LEDs 144 after the light is reflected by the reflector 132. (See FIG. 7B). The outer lens 164 is configured to refract the light emitted by the LEDs 144 after the light has been collimated by the collimating lens 142 and reflected by the reflector 132. In this indirect lighting configuration, light is emitted from the LEDs 144 in an upward direction through the collimating lens 142 for reflection off reflector 132. In this example, collimating lenses 142 are positioned atop respective LEDs 144. The collimating lenses 142 narrow the spread of light emitted by the LEDs 144. The reflected light may exit the lighting apparatus 100 through the outer lens 164. The reflector 132 preferably extends from the reflector plate 148 to the upper housing assembly (see FIGS. 1A, 1B, 2A, 2B, and 7B). As previously described, the reflector 132 may have a body portion 138 positioned above a cylindrical base portion 136. In this example embodiment, the circumference of the body portion 138 of the reflector gradually lessens as the body portion 138 extends down from the upper housing assembly 114 to the base portion 136 of the reflector 132. The base portion 136 of the reflector 132 may have a uniform circumference as the base portion 136 extends down from the body portion 138 to the reflector plate 148. (FIGS. 1A, 1B, 2B, 7A, 7B).

Figure 10A:
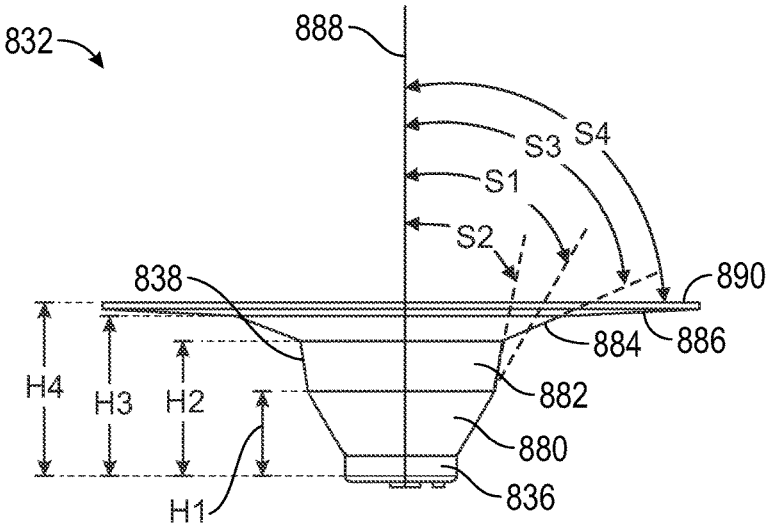
FIG. 10A is a diagram illustrating dimensions of an alternative embodiment of a reflector.

Referring now to FIG. 10A, an alternative reflector 832 is shown. The alternative reflector 832 is similar to the reflector 132 in that it is formed of a base 836 and a body 838. The body is formed of an upper portion 886, an upper intermediate portion 884, a lower intermediate portion 882, and a lower portion 880. The base 836 extends upwards to the lower portion 880. In this example, the height H1 of the base 836 may be approximately 0.5 inches (12.7 mm). The lower portion 880 of the body 838 may appear trapezoidal in shape, with the top end of the lower portion 880 being wider than the bottom end of the lower portion 880. The slope S1 of the lower portion 180 sidewalls may be approximately 30 degrees, for example, as measured from a central axis 888 of the reflector 832. The height H2 of the lower portion 880 may be around 1.811 inches (45.99 mm), for example. The lower intermediate portion 882 is positioned above the lower portion 880 and appears more rectangular, with the slope S2 of the sidewalls of the lower intermediate portion 882 being steeper than the slope S1 of the sidewalls of the lower portion 880. The slope S2 of the sidewalls of the lower intermediate portion 882 may be about 7.5 degrees, for example, as measured from a central axis 888 of the reflector. The height H3 of the lower intermediate portion 882 may be approximately 2.757 inches (70.03 mm), for example. The upper intermediate portion 884 is above the lower intermediate portion 882 and may, for example, appear trapezoidal. The upper intermediate portion 884 may have sidewalls with a shallower slope S3 than the lower intermediate portion 882. The upper intermediate portion 884 may have sidewalls with a slope S3 of around 67.5 degrees, as measured from a central axis of the reflector 832. The height H4 of the upper intermediate portion 884 may be about 3.251 inches (82.58 mm), for example. The upper portion 886 is above the upper intermediate portion 884, in this example, and may appear trapezoidal with sidewalls having a shallower slope S4 than any of the other portions. The upper portion 886 may have sidewalls with a slope S4 of around 87 degrees, for example, as measured from a central axis of the reflector 832. The upper portion 886 may extend upwards from the upper intermediate portion 884 and terminate at an upper rim 890. The upper rim 890 may, for example, be positioned above the bottom of the base 836 at a height 115 of approximately 3.5 inches (88.9 mm), for example.

Figure 10B:
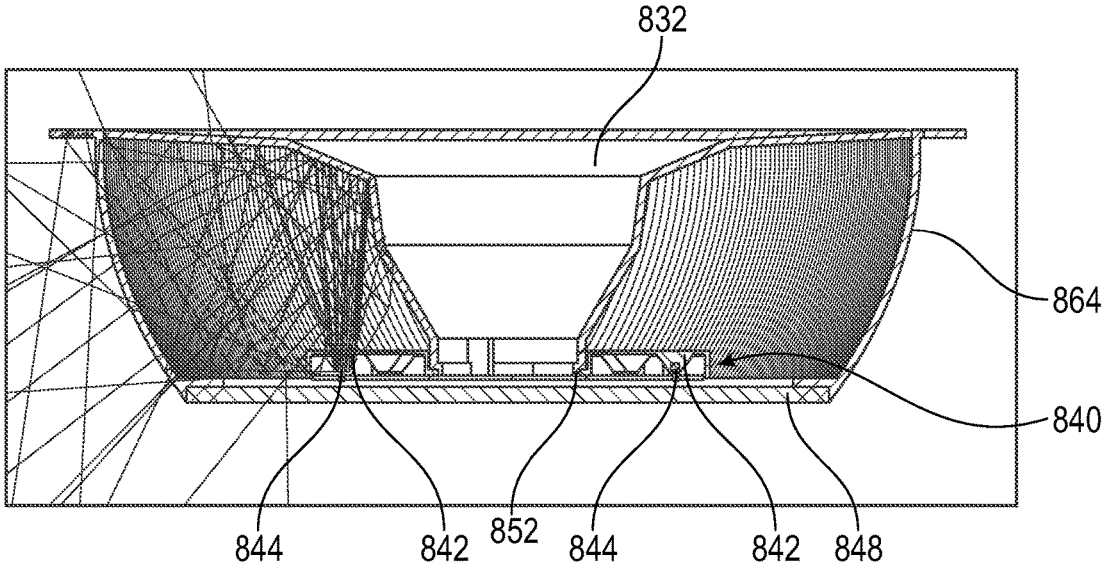
FIG. 10B is a cross section of the middle portion of an example lighting apparatus using the reflector of FIG. 10A, illustrating example paths of light rays from an LED light source.

As seen in FIG. 10B, collimated light may be reflect differently off of the alternative reflector 832 than the reflector 132 (in FIG. 7B). In this example, while the collimated light is emitted from the same position as in FIG. 7B, much less reflects off of the lower intermediate portion 882. On the other hand, more of the light is reflected into the reflector plate 848 by the reflector 832 in the example of FIG. 10B than was reflected into the reflector plate 148 by the reflector 132 in the example of FIG. 7B.

Figure 10C:
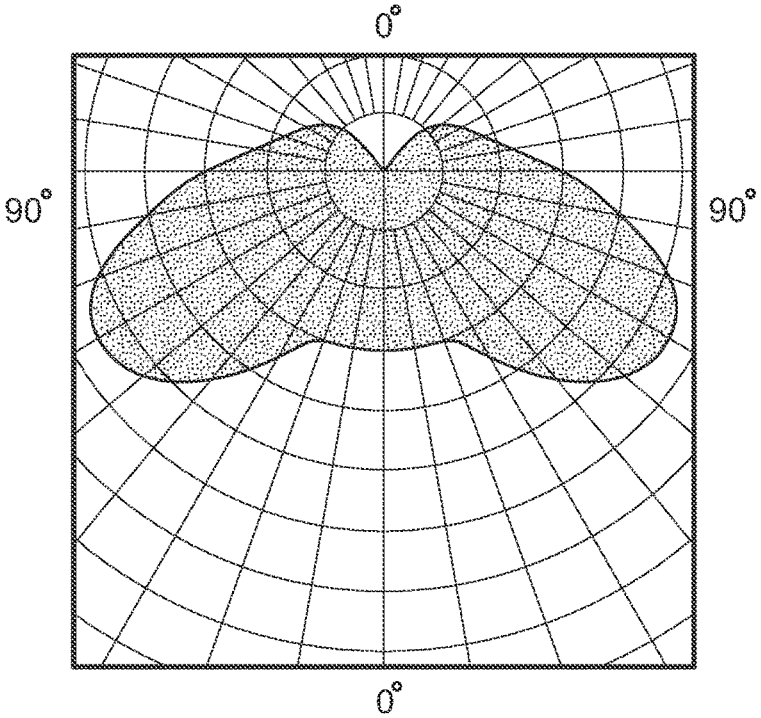
FIG. 10C is a candela plot illustrating example light patterns produced by the reflector of FIG. 10B.

Referring to FIG. 10C, it can be seen that the light reflected using the alternative reflector 832 has a different candela plot than that reflected using the reflector 132 illustrated in FIG. 7C. The candela plot of the reflector 832 indicates some broad area illumination at angles between ninety and seventy degrees. Some focused light is directed more or less directly downward at angles between twenty and zero degrees. The majority of the light exits the lighting apparatus at angles less than sixty degrees. Some of the light is also directed upwards to account for cave effect. The Illuminating Engineering Society of North America (IES) considers light emitted at angles of sixty degrees or less as having minimal glare effect. Thus, a lighting apparatus 800 using the reflector 832 may be able to illuminate a broad area while also further minimizing the perception of glare and addressing cave effect.

Figure 11A:
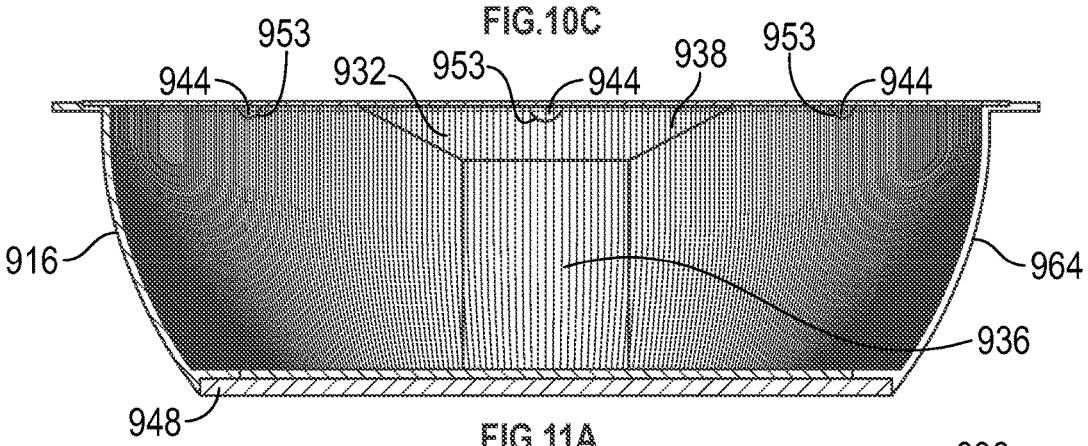
FIG. 11A is a side plan view of another alternative embodiment of a reflector with LEDs configured for direct light emission.
Figure 11B:
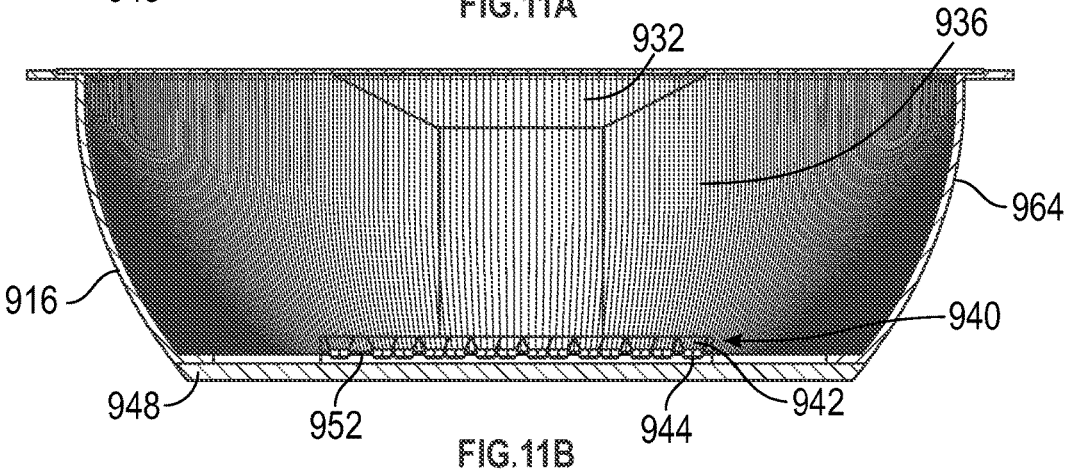
FIG. 11B is a side plan view of another alternative embodiment of the reflector in FIG. 11A with LEDs configured for indirect light emission.
Figure 11C:
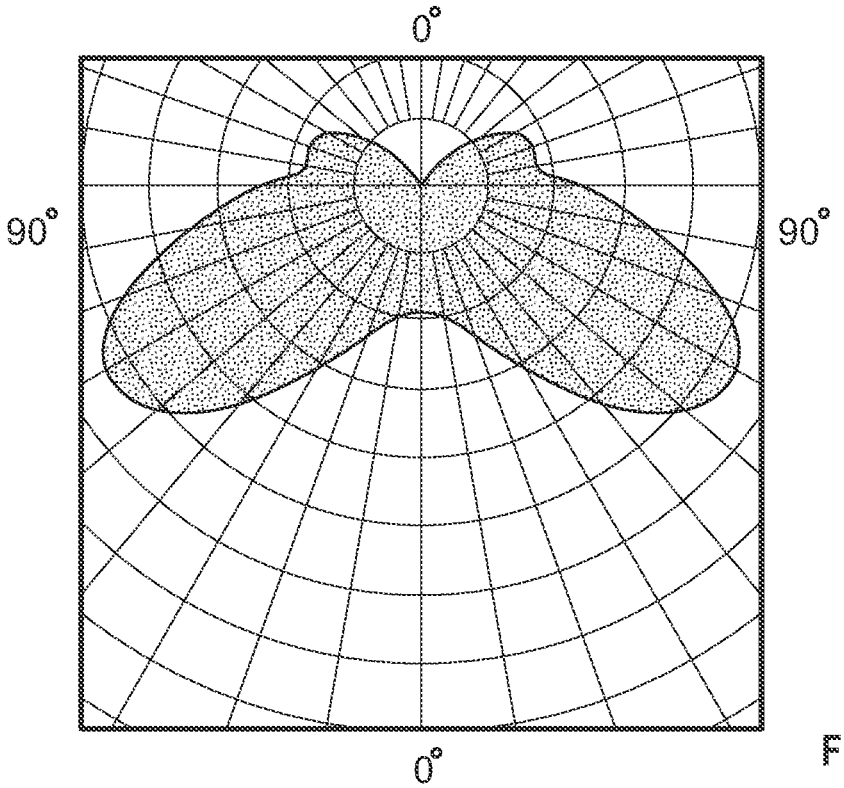
FIG. 11C is a candela plot illustrating example light patterns produced by a lighting apparatus using the alternative embodiment of the reflector of FIG. 11B.

Referring to FIGS. 11A and 11B, another alternative reflector 932 is presented. In this example, the reflector 932 has a large base portion 936 and a small body portion 938. The body portion 938 has only one section with uniformly sloping sidewalls throughout. The reflector 932 base 936 and body 938 may be formed of a high reflective white material and/or have a high reflective white finish. As may be seen in FIGS. 11A and 11B, the reflector 932 may be used with LEDs 944 attached above or below the reflector 932. The LEDs 944 may be fitted with collimating lenses 942 or, alternatively, with a die component that is positioned over individual LEDs 944. Referring to the candela plot of FIG. 11C, it can be seen that the reflector 932 reflects light in a pattern similar to the reflector of FIG. 10A, though with less focused downward light and more outwardly directed light in the seventy to forty degree range. Some light is also directed upwards to account for cave effect. Thus, a lighting apparatus 900 using the reflector 932 may be able to illuminate a broad area while also minimizing the perception of glare and addressing cave effect.

Notably, two or more of the reflectors 132, 832, 932 may be combined into a hybrid reflector (not shown) with an asymmetric formation. The hybrid reflector may be, for example, asymmetrical about at least one plane defined by a longitudinal axis of the reflector and a vector perpendicular to the longitudinal axis of the reflector. The hybrid reflector may be positioned within the middle housing assembly 116 such that the at least one LED 144 light source is configured to emit light towards the hybrid reflector. The hybrid reflector may thereafter reflect the light emitted by the LED 144 out through the outer lens 164 of the middle housing assembly 116.

The hybrid reflector may have a plurality of formations asymmetrically distributed around a longitudinal axis of the reflector. In one example, the formation of the reflector 132 might be used for one portion of the hybrid reflector while the formation of the reflector 832 might be used for another portion, and the formation of reflector 932 is used for yet another portion, and so on. In such an embodiment, the slope of the reflector at a given point along the longitudinal axis would change between formations, and each formation would be configured to reflect light in a different pattern. All the formations may be equally distributed among a surface area of the reflector, or some of the formations may be equally distributed among a surface area of the reflector while others aren't, or no one of the formations may cover the same amount of surface area as any other formation. The hybrid reflector may be asymmetric with respect to at least one axis or plane and symmetrical with respect to at least one different axis or plane. The hybrid reflector may also be used with a plurality of LEDs 144, such that the lighting apparatus 100 is configured to emit between 2,600 and 5,700 lumens.

Such a hybrid reflector may be ideal, for example, in an area or structure where vehicle and/or foot traffic flows past one particular area and not another. Thereby, the hybrid reflector may adopt the characteristics of reflector 132 facing the direction of traffic in order to minimize the chance that drivers and/or pedestrians will perceive glare while driving past. Thereafter, the characteristics of reflector 132 may be adopted, for example, in the other direction(s) so as to illuminate the broadest area possible without having to worry about potential perceptions of glare.

The lighting apparatus 100, as shown in FIGS. 1-7, may be used, for example, in new constructions to illuminate a broad area while minimizing the effect of glare, for example in a parking garage. The lighting apparatus preferably houses many LEDs positioned on an LED plate held at the lower housing assembly of the lighting apparatus. Example embodiments of the lighting apparatus may emit in a range between 2,600 and 5,700 lumens. To determine performance parameters of a lighting apparatus, various application spacings may be used such as: 30'×30'×9' and 2.5' from a wall or ceiling; 40'×25'×9' and 1' from a wall or ceiling; and/or 57'×30'×10' and 1' from a wall or ceiling. In one example, the lighting apparatus 100 may be able to emit in the range of 5000 initial source lumens and 3750 delivered lumens or more. The lighting apparatus 100 may be configured for 42 watts and 89 lumens per watt (LPW). Alternatively (or additionally), the lighting apparatus 100 may be configured for 44 watts and 85 LPW. Other alternative embodiments may range between 40 and 50 watts and 80 and 95 LPW. The lighting apparatus 100 may have a color rending index (CRI) of 70 with an alternative range of 60-80 CRI with correlated color temperatures having a range of 4000 Kelvin (K) to 5700 K. The lighting apparatus 100 may have 75% optical efficiency with a 75 degree main beam. 70%-80% optical efficiency with a 70-80 degree main beam may also be achieved. The lighting apparatus 100 may use XP-G2 LEDs, for example, with small dome and 10-20 degree optics. Various embodiments of lighting apparatus 100 may selectively use between 30-40 LEDs providing between 5,000-5,100 source lumens and 78 to 90 LPW. Alternative arrangements may provide the capability to emit 5700 lumens or more. In testing using 40 LEDs, a 57×30×10 ft layout and calculated from a point 1 foot from a wall or ceiling, for example, the lighting apparatus 100 was found to have an average foot candle (FC) of 1.5, a maximum FC of 2.5, a minimum FC of 1.1, an average/minimum of 1.4, a maximum/minimum (<10) of 2.3, a maximum Cd of 1560, and a maximum Cd angle of 45H, 75 V. In alternative examples, a 1.0-2.5 foot candle range may be employed.

An alternative lighting apparatus 600 using the reflector arrangement shown, for example, in FIG. 11B may be employed, for example, in upgrades and retrofits. Application spacing may selectively be 30'×30'×9' and 2.5' from a wall or ceiling; 40'×25'×9' and 1' from a wall or ceiling, and/or 57'×30'×10' and 1' from a wall or ceiling. The alternative lighting apparatus 600 may be able to emit in the range of 3500 initial source lumens and 2600 delivered lumens, or more. The alternative lighting apparatus 600 for 28 watts and 93 LPW. Alternatively (or additionally) the alternative lighting apparatus may be configured for 30 watts and 90 LPW. A range of 25-35 watts and 85-98 LPW may be employed. The alternative lighting apparatus 600 may have a CRI range of 60-80 with correlated color temperatures ranging from 4000 K to 5700 K with a 70%-80% optical efficiency and a 50-60 degree main beam. The alternative lighting apparatus 600 may use XP-G2 LEDs 144 with small dome and 10-20 degree optics. The alternative lighting apparatus 600 may selectively use between 30-40 LEDs providing between 3,500-3,600 source lumens and 85-96 LPW. In testing using 40 LEDs, a 30×30×9 ft layout and calculated from a point 2.5 feet from a wall or ceiling, example embodiments of the lighting apparatus were found to have an average foot candle (FC) of 2.4, a maximum FC of 3.5, a minimum. FC of 1.0, an average/minimum of 2.4, a maximum/minimum (<10) of 3.5, a maximum Cd of 457, and a maximum Cd angle of 15 H, 60V. In alternative examples, a 2.0-4.0 foot candle range may be employed.

Various embodiments of the lighting apparatus may have a type V distribution with 10% uplight. The glare control for the various embodiments may be <5,5000 cd/m2 measured from a 55 degree angle from Nadir, <3,860 cd/m2 measured from a 65 degree angle from nadir, <2,570 cd/m2 measured from a 75 degree angle from nadir, and/or <1,695 cd/m2 measured from an 85 degree angle from nadir.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

We claim:

1. A lighting apparatus, comprising:

a housing, including an outer lens;

at least one light source positioned within the housing;

a reflector having a longitudinal axis positioned within the housing, wherein the reflector comprises a plurality of portions, wherein a first portion is disposed continuously and circumferentially around the longitudinal axis at a first slope in relation thereto, wherein a second portion is disposed continuously and circumferentially around the longitudinal axis at a second slope in relation thereto; and a continuous space disposed about the reflector and between the reflector and the outer lens;

wherein the at least one light source is positioned within the continuous space such that light is emitted into the space; and wherein a portion of the emitted light is emitted towards the reflector whereby same light is reflected through the outer lens and a portion of the light is emitted away from the reflector and through the outer lens.

2. The lighting apparatus of claim 1, wherein the first slope is different from the second slope in relation to the longitudinal axis of the reflector.

3. The lighting apparatus of claim 2, wherein each portion is configured to reflect light in a different pattern.

4. The lighting apparatus of claim 3, wherein the plurality of portions are equally distributed among a surface area of the reflector.

5. The lighting apparatus of claim 3, wherein the plurality of portions are not equally distributed among a surface area of the reflector.

6. The lighting apparatus of claim 5, wherein there are at least three portions, and wherein at least two of the portions are equally distributed among a surface area of the reflector.

7. The lighting apparatus of claim 3, wherein no one portion covers the same amount of surface area as any other portion.

8. The lighting apparatus of claim 1, wherein the at least one light source further comprises a plurality of LEDs such that the lighting apparatus is configured to emit between 2,600 lumens and 5,700 lumens.

9. A lighting apparatus, comprising:

a housing including an outer lens;

at least one light source disposed within the housing;

a reflector having a longitudinal axis is positioned within the housing, wherein the reflector is disposed continuously and circumferentially around the longitudinal axis, wherein the reflector comprises a body portion and a base portion, wherein the body portion is disposed above the base portion, wherein circumference of the body portion is reduced with distance from above toward the base portion; and a continuous space disposed about the reflector and between the reflector and the outer lens such that the space increases with distance from above toward the base portion;

wherein the at least one light source is positioned within the continuous space such that light is emitted into the space; and wherein a portion of the emitted light is emitted towards the reflector whereby same light is reflected through the outer lens and a portion of the light is emitted away from the reflector and through the outer lens.

10. The lighting apparatus of claim 9, wherein the base portion is cylindrical.

11. The lighting apparatus of claim 10, wherein the at least one light source comprises a plurality of LEDs, and wherein the plurality of LEDs surround the base portion such that light emitted therefrom towards the body portion is reflected from the body portion of the reflector.

* * * * *